United States Patent [19]

Stahlecker et al.

[11] Patent Number: 4,598,539

[45] Date of Patent: Jul. 8, 1986

[54] YARN PIECING ARRANGEMENT FOR AN OPEN-END FRICTION SPINNING MACHINE

[75] Inventors: Fritz Stahlecker, Josef-Neidhart-Strasse 18, 7347 Bad Überkingen; Hans Stahlecker, Haldenstrasse 20, 7334 Süssen, both of Fed. Rep. of Germany

[73] Assignees: Hans Stahlecker; Fritz Stahlecker, both of Fed. Rep. of Germany

[21] Appl. No.: 663,960

[22] Filed: Oct. 23, 1984

[30] Foreign Application Priority Data

Oct. 26, 1983 [DE] Fed. Rep. of Germany ..... 3338833

[51] Int. Cl.[4] ..... D01H 7/885; D01H 11/00; D01H 15/02

[52] U.S. Cl. ..... 57/263; 57/301; 57/305; 57/401

[58] Field of Search ..... 57/263, 261, 301, 304, 57/401, 22, 23, 305

[56] References Cited

U.S. PATENT DOCUMENTS

| | | | |
|---|---|---|---|
| Re. 30,201 | 2/1980 | Stahlecker et al. | 57/263 |
| 3,605,396 | 9/1971 | Guignard et al. | 57/263 X |
| 3,780,513 | 12/1973 | Watanabe et al. | 57/263 X |
| 3,987,610 | 10/1976 | Stahlecker et al. | 57/263 |
| 4,059,946 | 11/1977 | Böttcher et al. | 57/263 |
| 4,083,171 | 4/1978 | Konig et al. | 57/263 |
| 4,172,357 | 10/1979 | Stahlecker et al. | 57/263 |
| 4,222,225 | 9/1980 | Stahlecker et al. | 57/263 |
| 4,367,623 | 1/1983 | Parker et al. | 57/401 X |
| 4,423,517 | 9/1980 | Husges et al. | 57/263 X |
| 4,498,283 | 2/1985 | Kodama et al. | 57/261 |

FOREIGN PATENT DOCUMENTS

| | | | |
|---|---|---|---|
| 34427 | 8/1981 | European Pat. Off. . | |
| 2658441 | 6/1978 | Fed. Rep. of Germany | 57/301 |
| 2939644 | 4/1981 | Fed. Rep. of Germany . | |
| 3337120 | 4/1984 | Fed. Rep. of Germany | 57/263 |

*Primary Examiner*—Stuart S. Levy
*Assistant Examiner*—Joseph J. Hail, III
*Attorney, Agent, or Firm*—Barnes & Thornburg

[57] ABSTRACT

For the piecing of a yarn of a spinning unit of an open-end friction spinning machine, it is provided that a yarn an brought into the wedge-shaped gap is pieced, while forming a yarn piecing, which, before a renewed winding-up of the yarn, is cut out and is replaced by a yarn connection connecting the new yarn with the yarn leading to the spool. The formation of the yarn piecing takes place at a production speed that is reduced as compared to the normal spinning operational speed, said production speed being brought to the operational value only after the making of the yarn connection. It is also provided that the yarn spun during the formation of the yarn connection is taken up by a yarn storage device, which is emptied more rapidly because of the fact that the wind-up speed as compared to the withdrawal speed has a larger speed difference than the operational wind-up speed has with respect to the operational withdrawal speed.

13 Claims, 19 Drawing Figures

16
14

130
131
110
105
104
132
133
135
134
89
90
125
137
120
122
83
129
121
126
124
140
123
113
115
114
112
7
119
118
9
18
19
6
47
4
117
116
37
42
1
5
55
63
62
38

16
14
53
132
10
147
54
13
130
125
144
50
142
143
121
126
120
140
122
124
123
112
7
9
4
116
42
1

16
14

158
107
106
54
53
104
100
99
98
101
97
103
13
50
102
160
12
11
49
93
34
80
79
94
96
95
81
76
163
33
32
24
78
77
159
82
7
74
9
45
18
1
43

16B
183
184
54
14
53
104
158
100
99
174
167
97
13
170
168
169
103
50
12
11
187
111
49
93
186
189
190
192
191
188
29
30
24
9
7
18
20
71
37
1
70
69
73
72
38
182
66
39

16C
14
158
140
177
145
144
178
196
174
199
125
197
194
97
13
12
11
200
126
93
120
140
198
195
24
112
7
18
4
116
42
1

16C
14

158
202
177
145
144
178
180
125
200
141
181
122
126
120
121
140
195
123
174
24
112
7
116
4
1
97

YARN PIECING ARRANGEMENT FOR AN OPEN-END FRICTION SPINNING MACHINE

BACKGROUND AND SUMMARY OF THE INVENTION

This invention relates to a process and apparatus for piecing yarn on a spinning unit of an open-end friction spinning machine having a large number of spinning units. Spinning units of the type contemplated by the invention each contain two rollers that are drivable in the same rotational direction and are arranged next to one another and form a wedge-shaped gap serving as a yarn spinning or forming region. At least one suction device affects the wedge-shaped gap and there is also provided a feeding device for the feeding of single fibers to the wedge-shaped gap, a yarn withdrawal device for withdrawing the formed yarn, and a winding device for the winding of the yarn onto a spool.

A manual piecing process is known in the case of an open-end friction spinning unit—see European Published Unexamined Patent Application (EP-OS) No. 34 427. In the case of this spinning unit, only one of the two rollers is constructed as a so-called suction roller, which is provided with a perforated shell and a suction insert arranged in its interior and aiming at the wedge-shaped gap with a suction slot. The second roller has a closed shell surface. During the piecing, the wind-up roller is lifted off its operational drive, after which the broken yarn end is found and unwound manually and shortened to a predetermined length. This length is such that the end of the yarn end reaches the yarn forming point, i.e., arrives in the area of the mouth of one of the fiber feeding channels opposite the wedge-shaped gap. After the cutting to length, the yarn end, while avoiding the withdrawal device of the spinning unit, is led to a yarn withdrawal tube, from where it is sucked into the spinning unit because the vacuum of the suction device affecting the wedge-shaped gap is maintained. By the manual operation of a covering of the suction insert, the yarn end is to be sucked into the spinning unit, while the suction slot of the suction device is gradually closed so that the suction effect is switched off at the end of the insertion process. The yarn end must then be held by a suction withdrawal device arranged as an extension of the wedge-shaped gap. After the suction device is switched on again by the opening of the covering of the suction slot, the yarn end should arrive in the wedge-shaped gap. If possible, the feeding of the fibers is to be started at the same time as the suction device is switched back on, after which the yarn withdrawal is resumed by the placing of the wind-up spool on its driving roller. Then the newly pieced yarn is manually placed in the withdrawal device. The yarn piecing produced during the piecing process is wound onto the spool. By means of this process, yarn piecings cannot be obtained which have a good enough quality compared with the quality of the normally spun yarn to be left in the yarn when the yarn is processed further. Rather these piecings must be cleaned out and replaced by another yarn connection on a spooling machine before a further processing of the yarn.

In the case of open-end rotor spinning machines—see German Patent (DE-PS) No. 29 39 644—it is known to carry out a piecing process by means of a travelling servicing apparatus at a spinning unit during full production speed, where the obtained yarn piecing, before the winding-up of the pieced yarn, is detached by the drivable servicing apparatus and is replaced by a knot. The yarn produced during the knotting is sucked into a pneumatic yarn-storage device existing at each spinning unit. Apart from the fact that a yarn connection in the form of a knot will hardly be accepted in modern machines, the known type of piecing cannot be carried out in open-end friction spinning because operating speeds exist there which correspond to about three times the operating speeds in the case of open-end rotor spinning machines. During the making of the yarn connection, yarn production continues, without the occurrence of a winding process. In the case of the high operating speeds, quantities of yarn would occur which could either not be stored in a yarn storage device or could not be stored there properly.

The invention is based, at least in part, on the objective or providing a process and a device or apparatus for piecing a yarn at individual spinning units of an open-end friction spinning machine that can be carried out fully automatically and that ensures that the spools of yarn produced on the open-end friction machine can be further processed directly without having to be subjected to another work step.

This objective is achieved according to the invention by providing an arrangement wherein a yarn end that is brought into the wedge-shaped gap is pieced with incoming fibers to form a yarn piecing. The yarn piecing is detached from the yarn before a renewed winding-up of the yarn and is replaced by a yarn connection connecting the newly produced yarn with the yarn leading to the spool, where the production of the yarn piecing takes place with control of the friction effect of the rollers, the quantity of the fed fibers and the withdrawal speed. The yarn production rate is reduced as compared to the normal spinning operating speed, wherein the normal spinning operating values are reached only after the yarn connection with the newly formed yarn has been made. The yarn spun during the making of the yarn connection is received by a yarn storage device, and the winding-up after the making of the yarn connection takes place at a wind-up speed which exhibits a higher speed difference with respect to the withdrawal speed than the normal spinning operational wind-up speed exhibits with respect to the normal spinning operational withdrawal speed.

The invention is based, at least in part, on the recognition that it is feasible in open-end friction spinning to also spin at a production speed that is much lower than the operational production rate, even as low as, for example, only ten percent of the operational production rate. The individual process steps can therefore be carried out relatively slowly so that the design requirements for the controlled timed element operations need not be too high, especially since the yarn piecing produced during the piecing process is subsequently detached and discarded and is not wound onto the spool of finished yarn. The yarn quantities occurring during the low production speed that must be stored during the making of the yarn connection can then be handled. Since the winding-up of the newly spun yarn takes place at a speed that permits a high difference in speed as compared to the withdrawal speed, which is higher than the normal speed difference during the normal spinning operation, the storage device can be emptied in a relatively short time so that overall the working time of a servicing apparatus required for a piecing process at a spinning unit can be kept relatively short.

According to a further aspect of preferred embodiments of the invention, it is provided that for the production of the yarn piecing or immediately after the production of the yarn piecing, the friction effect of the rollers, the quantity of the fed fibers and the withdrawal speed are adjusted to values that are reduced with respect to the normal spinning operational values, said reduced values being adapted to one another in such a way that during this phase, a yarn is spun which, in regard to the yarn count, corresponds to the normal operationally spun yarn. As a result, it is ensured that the yarn that is supplied to the yarn storage device and is subsequently wound onto the spool does not differ from the yarn produced during normal spinning operations. In this case, it can be provided according to certain preferred embodiments that the production of the yarn piecing itself takes place at a production speed which furnishes a yarn count that does not correspond to the yarn count spun at operational conditions, but only ensures that a successful piecing process takes place. Since the yarn piecing is detached and is not wound onto the spool and since, after the production of the yarn piecing, the same yarn count is spun as under operational conditions, yarn of the same yarn count will be wound onto the spool only later after the yarn piecing section has been discarded.

In certain preferred embodiments of the invention, it is provided that the friction effect of the rollers, the quantity of the fed fibers, and the withdrawal speed during the increase to their operational values (run-up phase) are adapted to one another in such a way that during this phase a yarn is spun having a yarn count that corresponds to the yarn spun at the operational values. This ensures that the yarn spun during the run-up phase that is wound onto the spool also corresponds exactly to the yarn spun under operational conditions.

In a further development of certain preferred embodiments of the invention, it is provided that the changing of the friction effect of the rollers, the increasing of the quantity of the fed fibers and the increasing of the withdrawal speed to the operational values takes place with a time delay with respect to the start of the spool winding-on process. As a result, the emptying of the yarn storage device takes place relatively rapidly since the emptying of the storage device takes place or is at least started at the low production speed.

In a further development of certain preferred embodiments of the invention, it is provided that for the reduction of the friction effect of the rollers, the rotating speed of the rollers is reduced. In another development or possibly in addition, it is provided that for the reduction of the friction effect of the rollers, the suction effect of the suction device is throttled.

In a further development of certain preferred embodiments of the invention, it is provided that the yarn end to be entered into the wedge-shaped gap is drawn off the spool, is returned into the spinning unit against the withdrawal direction and after the production of the yarn piecing in the shape of a loop is led to a suction withdrawal device, after which the portion of the loop containing the yarn piecing is cut out, and subsequently the ends of the loop are twisted together to form a yarn connection at a splicing mechanism separate from the friction rollers. In this case, during the twisting-together to form the yarn connection, the continuously produced and withdrawn newly spun yarn is directed to a yarn storage device that in running direction is located behind the withdrawal device and in front of the twisting section, said yarn, after the twisting-together, being withdrawn from the yarn storage device by the switching-on of the wind-up device. In the case of this embodiment, the yarn end withdrawn from the spool of the spinning unit is used directly, as needed, after a corresponding preparation of its extreme end, for carrying out the piecing process.

According to another development of preferred embodiments of the invention, it is provided that a yarn end having a predetermined length is introduced into the spinning unit in the withdrawal direction, is inserted into the wedge-shaped gap and, while the yarn piecing therewith is being produced, is withdrawn with the newly spun yarn in the withdrawal direction and is guided away in a suction withdrawal device. Subsequently the newly spun yarn, after being detached at least up to the yarn piecing, is twisted (spliced) together with a yarn end removed from the spool. In this case, during the twisting operation, the newly spun yarn is stored in a yarn storage device arranged in front of the twisting point and behind the withdrawal device, the yarn storage device being emptied after the twisting-together by the switching-on of the wind-up device. In the case of this process, a yarn end is introduced into the wedge-shaped gap in the withdrawal direction which is possible because with the production of the yarn piecing, the final connection to the yarn already wound-up on the spool is not yet established. In this case, it is useful according to contemplated preferred embodiments to remove the yarn end introduced into the spinning aggregate for the piecing, in the withdrawal direction, by means of an auxiliary spool. Auxiliary yarn may be used which clearly differs from the yarn to be spun in the normal spinning operation, out which advantageously significantly facilitates the piecing itself.

Further objects, features, and advantages of the present invention will become more apparent from the following description when taken with the accompanying drawings which show, for purposes of illustration only, embodiments constructed in accordance with the present invention.

DETAILED DESCRIPTION OF THE DRAWINGS

Figure 1:
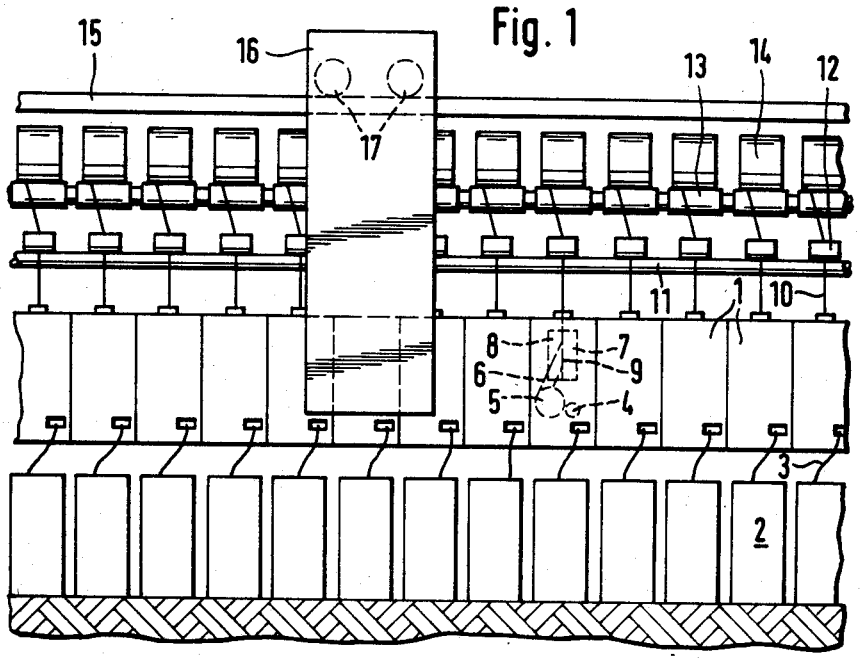
FIG. 1 is a front schematic view of a part of an open-end friction spinning machine having a drivable servicing apparatus constructed in accordance with the present invention.

The open-end friction spinning machine according to FIG. 1 has a large number of similarly constructed spinning units 1 arranged next to one another. A sliver 3 to be spun is fed from a can 2 to each spinning unit 1. The sliver 3 is offered via a feeding device containing a feeding roller to a rapidly running opening roller 5 which separates the sliver 3 into individual fibers. Via a fiber feeding channel 6 the fibers arrive in the area of the wedge-shaped gap 9 of two friction rollers 7 and 8 that are arranged next to one another. The yarn 10 that is spun in the wedge-shaped gap 9 serving as the yarn forming region or point is withdrawn from the respective spinning unit 1 by means of a pair of withdrawal rollers which consists of a bottom roller 11 that is driven and runs continuously in longitudinal direction of the machine and of respective single top rollers 12 resting on said bottom roller. Subsequently, the yarn 10 is wound on spools 14 that are driven via grooved drums 13 arranged on a driven shaft that runs continuously in the longitudinal direction of the machine.

Above the spinning units 1, rails 15 are mounted at the open-end friction spinning machine on which a servicing apparatus 16 can be driven by means of running wheels 17 along the open-end friction spinning machine. The servicing apparatus 16, in a known manner, is provided with a detector which receives a signal emitted by a signal transmitter when a yarn breakage exists, stopping the servicing apparatus 16 and placing it at the corresponding spinning unit 1.

Figure 2:
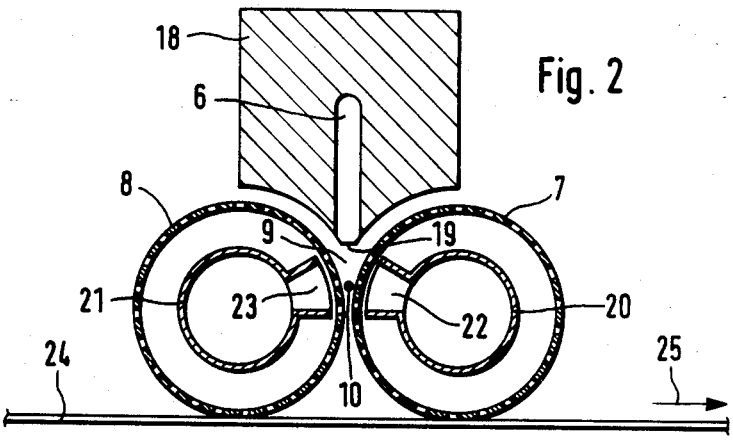
FIG. 2 is an enlarged cross section through the two rollers and a fiber feeding channel of a spinning unit of an open-end friction spinning machine of the type contemplated by the present invention.
Figure 3:
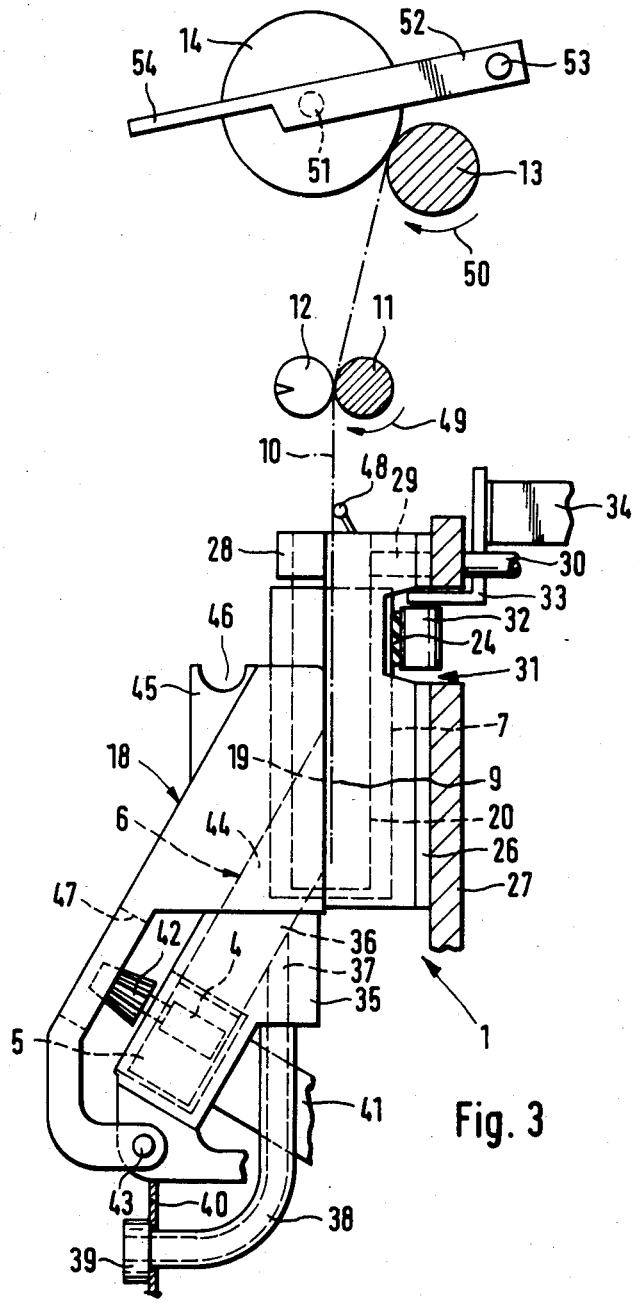
FIG. 3 is an enlarged schematic sectional view through a single spinning unit of the open-end friction spinning machine of FIGS. 1 and 2.

The two rollers 7 and 8 (FIG. 2) that are arranged next to one another in a plane extending in the longitudinal direction of the machine have perforated shell surfaces. In the inside of the rollers 7 and 8, suction inserts 20 and 21 are arranged which, via a suction pipe 29, 30 (see FIG. 3) are connected with a vacuum source that is not shown. The suction inserts 20 and 21 have suction slots 22 and 23 that are delimited by webs that are arranged closely to the inside surfaces of the shell surfaces of the rollers 7 and 8, said suction slots 22 and 23 being aimed at the area of the wedge-shaped gap 9. In the tapering area of the wedge-shaped gap, the twisting-together of the yarn 10 takes place from the individual fibers. The individual fibers are fed via a fiber feeding channel 6 having a slot-shaped cross section mouth 19 projecting into the wedge-shaped gap 9. By means of the suction inserts 20 and 21 and the suction slots 22 and 23, a suction pull is generated in the fiber feeding channel 6 and in the wedge-shaped gap 9, by means of which suction pull the fibers are brought into the wedge-shaped gap 9 and the yarn 10 is held in the wedge-shaped gap 9.

The rollers 7 and 8 are driven in the same rotational direction by a tangential belt 24 running in the direction of the arrow 25 in the longitudinal direction of the open-end friction machine and resting directly against the rollers 7 and 8. The same tangential belt 24 drives all rollers 7 and 8 of the spinning units 1 of one side of the machine.

The rollers 7 and 8 are disposed on the suction inserts 20 and 21 by means of roller bearings. The suction inserts 20 and 21 (FIG. 3) are held in a roller housing 26 which itself is fastened at a longitudinal member 27 of a machine frame. The suction inserts 20 and 21, by means of clamp holders 28, are clamped into bowl-shaped receiving means of the roller housing 26. In the area of these receiving means, the insides of the suction inserts 20 and 21 are acted upon by a vacuum via a cross hole 29 and a vacuum pipe 30, both suction inserts 20 and 21 being closed on the front or facing other side.

The supporting profile 27 and the roller housing 26, on the rear side, are provided with a recess 31, the tangential belt 24 running in the area of said recess 31. This tangential belt 24, by means of tension rollers 32, is pressed against the surfaces of the rollers 7 and 8. The tension rollers 32 are fastened on holders 33 which are loaded by means of leaf springs 34 in the direction of the rollers 7 and 8.

Below and at the side of the wedge-shaped gap 9 serving as the yarn forming point, in front of the roller housing 26, an opening-roller housing 35 is arranged which surrounds the opening roller 5. The opening roller 5 is disposed in a shell-type extension 41 of the opening roller housing 35. In a manner that is not shown, it projects out of this extension 41 and carries a driving wharve via which it is driven by a tangential belt running continuously in longitudinal direction of the machine. The feeding roller 4, which is arranged in parallel to the axis of the opening roller 5, is also provided with a central drive, such as a worm shaft, that is not shown. In this drive, a switching coupling means is arranged which is opened for the interruption of the fiber supply. As an extension of the feeding roller 4, a bevel wheel 42 is arranged at this feeding roller 4, said bevel wheel 42 being accessible to an auxiliary driving device which will be explained later.

A first part 36 of the fiber feeding channel 6 starts at the opening roller 5 in the opening roller housing 35, said first part 36 continuing by means of a part 44 in a partial housing 18 that can be swivelled away, said partial housing 18 also containing the mouth 19 (see also FIG. 2) of the fiber feeding channel 6. The partial housing 18 can be swivelled away around a shaft 43 that is located below the opening roller 5 in such a way that the area of the wedge-shaped gap 9 of the rollers 7 and 8 is exposed. A recess 47 is provided in the partial housing 18, via which the bevel wheel 42 is accessible to the feeding roller 4. In addition the partial housing 18 is provided with a projection 45 having a curve-shaped recess 46.

In withdrawal direction behind the rollers 7 and 8, a yarn feeler 48 of a yarn monitoring switch that is not shown is arranged which is held in a control position by the moving yarn. In the case of a yarn breakage, the yarn feeler 48 swings into its resting position, by means of which, via the yarn monitoring switch, the coupling of the feeding roller 4 is opened so that the fiber supply is interrupted. By means of the yarn monitoring switch, the already mentioned signal transmitter can also be activated which causes the servicing apparatus 16 to stop at the corresponding spinning unit 1 and carry out the servicing work.

The yarn withdrawal device which is arranged behind the rollers 7 and 8 in yarn withdrawal direction consists of the bottom roller 11 which is constructed as a continuously running cylinder that is driven in the direction of the arrow 49. At the time of a yarn breakage, the bottom roller 11 continues to run. In the case of a yarn breakage, the grooved roller 13 rotating in the direction of the arrow 50 also continues to run, the spool 14 resting on said grooved roller 13 and being driven by it. The spool tube 51 of the spool 14 is held in a spool creel 52 that can be swivelled around a shaft 53 arranged at the machine frame. The spool creel 52, at least on one side, is extended beyond the diameter of the spool 14 by means of a projection 54 so that, when necessary, the spool creel 52 with the spool 14 can be lifted off.

Figure 4:
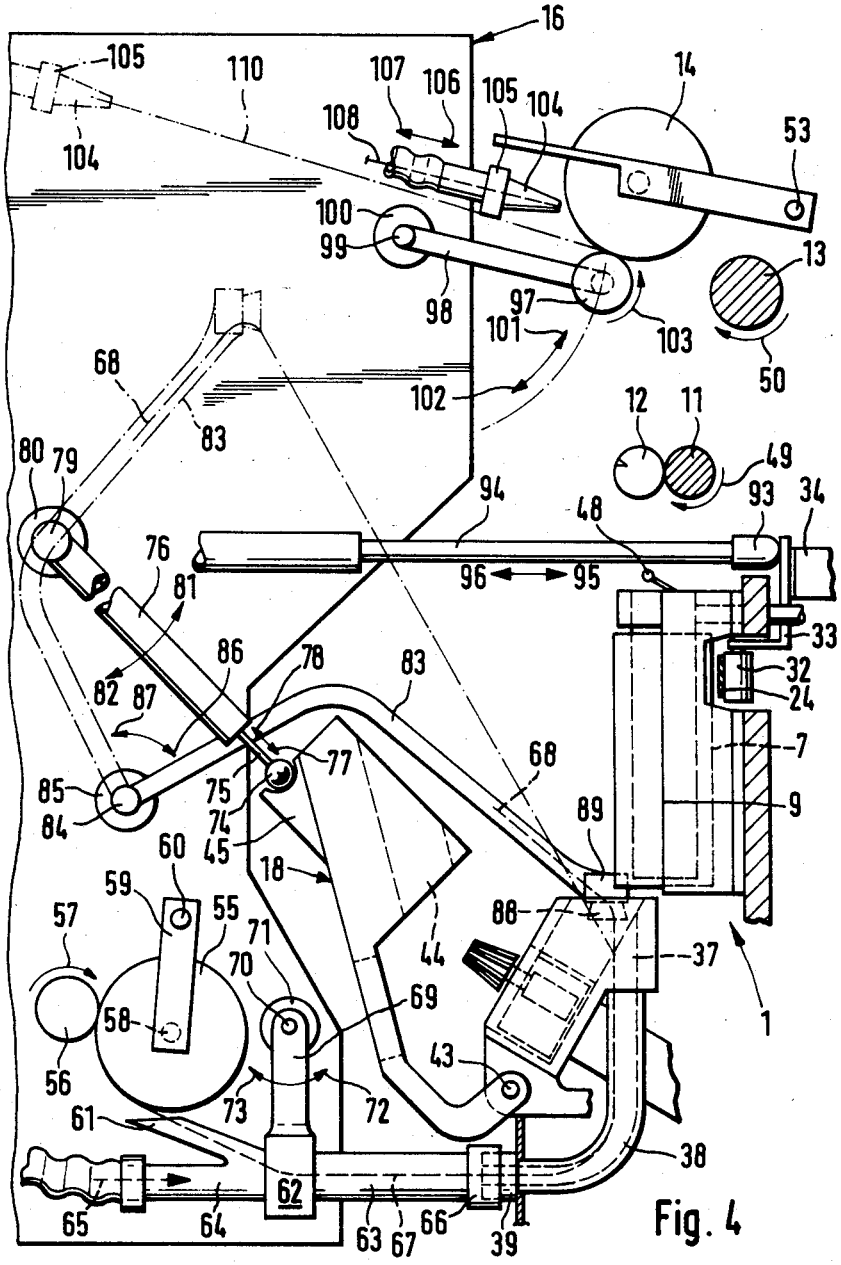
FIGS. 4 to 8*a* are schematic sectional views depicting the positioning of the operational elements of a spinning unit and a mobile servicing unit during various stages of a piecing and winding operation, according to a preferred embodiment of the invention.

FIG. 4 shows a spinning unit 1 in which a yarn breakage has occurred. The yarn feeler 48 has taken up its inoperative position so that by the opening of the coupling leading to the feeding roller 4, the fiber supply was interrupted. In addition, the servicing apparatus 16 was called to the spinning unit 1 which now carries out the first steps of a yarn piecing process.

The servicing apparatus 16, by means of a piston cylinder unit 76, has swivelled away the partial housing 18 into the opened position. The piston cylinder unit 76 can be swivelled via a motor operator 80 around a shaft 79 corresponding to the arrows 81 and 82. It has a piston rod 75 having a spherical head 74 engaging in the recess 46 of the partial housing 18, said spherical head 74 being able to be moved in and out corresponding to the directions of the arrows 77, 78.

The servicing apparatus 16 contains an auxiliary spool 55 with an auxiliary yarn, the spool tube 58 of which is held in a spool carrier 59 that can be swivelled around a shaft 60 and, by means of a spring loading, can be pressed against a roller 56 driving the auxiliary spool 55 in unwinding direction (arrow 57), said roller 56 being provided with a driving motor. The auxiliary yarn 67 is introduced into an injection pipe 61 which, via a combined cutting and clamping device 62, leads to a compressed air pipe 63 which is provided with a connection 66 that is assigned to a connection 39 of the spinning unit 1. The compressed air pipe 63, and thus also the injection pipe 61, are held so that they can be swivelled by means of a holder 69 which can be swivelled around a shaft 70 of the servicing apparatus 16 by means of a motor operator 71 in the direction of the arrows 72 and 73 so that the connection 66 can be placed at the connection 39 and can also be moved away again. The injection pipe 61 leads into a compressed air supply pipe 64 which is arranged in the servicing apparatus 16 as an extension of the compressed air pipe 63 and through which compressed air 65 can be fed.

An air pipe 38 is connected to the connection 39, said air pipe 38 leading to a duct 37 leading into the part 36 of the fiber feeding channel 6.

The auxiliary yarn 67 is wound so far off the auxiliary spool 55 and blown into the connecting pipe 38 which is developed as an elbow of the channel, and into the channel 37 that it projects out of the mouth of the channel 37 and can be grasped by a suction piece 83 of the piecing device, which suction piece 83 is placed at the mouth of the channel 37 after the swivelling-away of the partial housing 18. The suction piece 83 is connected to a vacuum source and can be swivelled around a shaft 84 by means of a motor operator 85 corresponding to the direction of the arrows 86 and 87. At its end, the suction piece 83 has an intake funnel 88 to which a cutting device 89 is connected. The end 68 of the auxiliary yarn 67 is sucked into the suction piece 83 sufficiently far, after which, while the unwinding of the auxiliary yarn 67 from the auxiliary spool 55 is continued, the suction piece 83 is swivelled into the dash-dotted position, so that the auxiliary yarn 67 is held in a taut condition between the partial housing 18 and the rollers 7 and 8.

The drive of the rollers 7 and 8 had been interrupted during the above-described process steps. For this purpose a rod 94 that can be adjusted corresponding to the directions of the arrows 95 and 96 is mounted at the servicing apparatus 16, said rod 94, by means of a thrust piece 93, being placed at the holder 33 of the tension roller 32 in such a way that said holder 33 with the tension roller 32 is moved away against the effect of the leaf spring 34 from the rollers 7 and 8, by means of which the tangential belt 24 lifts off the rollers 7 and 8.

Also during the process steps described above, a spool lifting roller 97 is assigned to the spool 14, said spool lifting roller 97 being carried on a lever 98. By means of a motor operator 100, lever 98 can be swivelled corresponding to the arrows 101 and 102. The spool lifting roller 97 has a drive driving it in unwinding direction of the spool 14 (direction of arrow 103). After the lifting of the spool 14 off the grooved drum 13, a suction nozzle 104 of the servicing apparatus 16 is placed at the spool 14, said suction nozzle 104 searching for the broken yarn end, while the spool 14 is driven by the spool lifting roller 97 in unwinding direction. The suction nozzle 104, that can be moved corresponding to the direction of the arrows 106 and 107, is connected to a vacuum pipe 108. It also contains a cutting device 105. After receiving the broken yarn end, the suction nozzle 104 is moved back into the dash dotted position, in which case a corresponding length of yarn is unwound from the spool 14.

Figure 5:
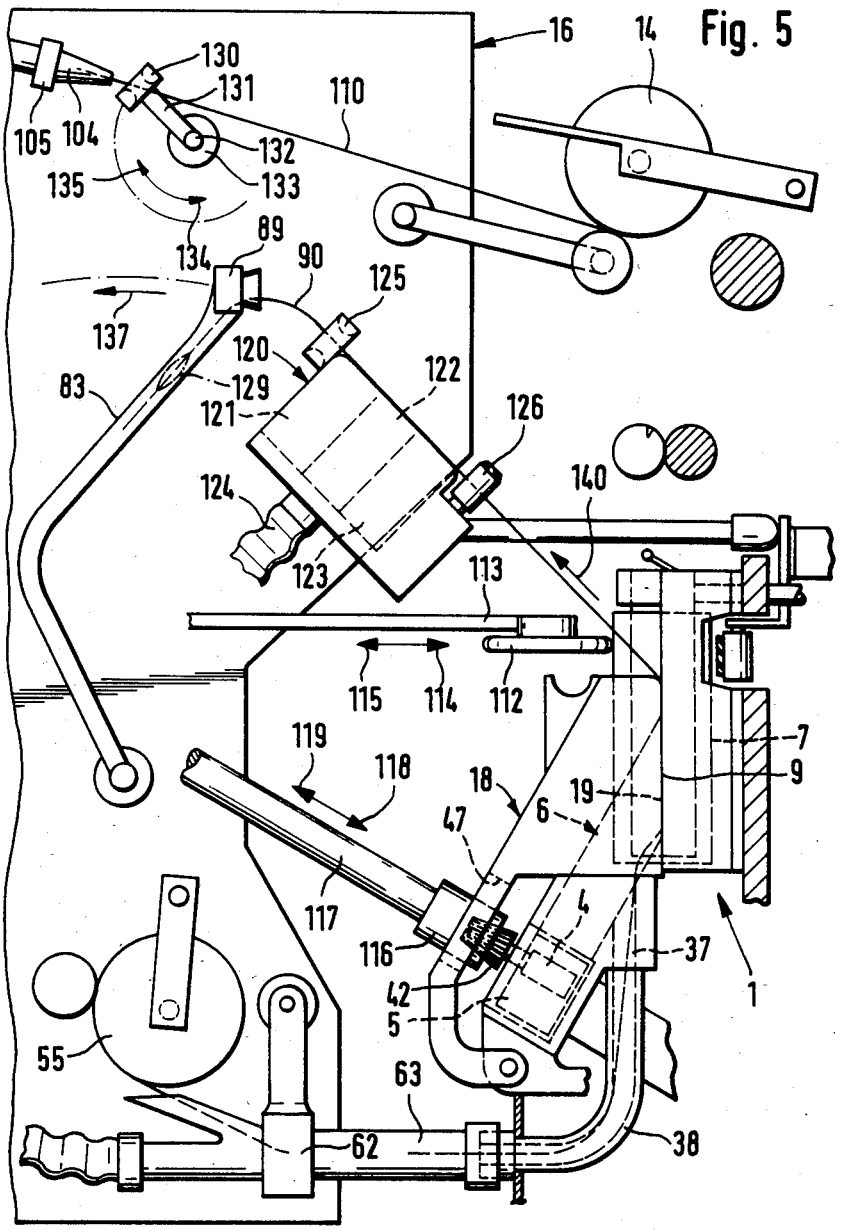

After these preparatory steps, the partial housing 18 is returned to its operational position (FIG. 5). Connecting to the mouth 19, the partial housing 18 is provided with a threading slot that corresponds approximately to the cross section of the yarn and preferably has intake slants, so that the auxiliary yarn reaches part 44 of the fiber feeding channel and in the area of the mouth 19 of the fiber feeding channel is placed in the wedge-shaped gap. A yarn storage device 120 is placed at the yarn held tautly between the partial housing 18 and the suction pipe 83, said yarn storage device being subdivided into chambers 121, 122 and 123 that are located behind one another in moving direction of the yarn. The chambers 121, 122 and 123, via a control element that is not shown, such as a slide element, are connected to a vacuum pipe 124 in such a way that the individual chambers 121, 122 and 123 can successively be connected to the vacuum source and can also be separated again from it. At the yarn storage device 120 a pair of auxiliary withdrawal rollers 126 is arranged on the yarn entrance side, said pair of auxiliary withdrawal rollers 126 being connected to a continuously adjustable driving motor. The two rollers 7 and 8 of the pair of auxiliary rollers 126 can be moved apart in such a way that the yarn can freely pass through. A yarn clamp 125 is arranged behind the yarn storage device 120 in the moving direction of the yarn, the yarn passing through said yarn clamp 125.

The feeding roller 4 can be driven via an auxiliary drive of the servicing apparatus 16. For this purpose, a coupling part 116 having a corresponding bore is fitted on the bevel wheel 42, said coupling part 116 being arranged on a shaft 117, which is driven by a continuously running-up driving motor. The shaft 117 with the coupling part 116 can also be moved out corresponding to the direction of the arrows 118 and 119.

Also for the rollers 7 and 8, an auxiliary drive is provided containing a friction wheel 112 which time is simultaneously pressed against the shell surfaces of the two rollers 7 and 8 by means of a rod 113 that can be moved out corresponding to the direction 114 and 115 of the arrows. The friction wheel 112, via a continuously running-up driving motor, can be driven in such a way that the rollers 7 and 8 are driven in the same rotational operational direction.

The servicing apparatus 16 contains a programmed control system for controlling the start of the operation and the placing of the individual devices with respect to their time-related sequence. In particular, the programmed control system controls the switching-on of the auxiliary drives for the feeding roller and the rollers 7 and 8 as well as the auxiliary withdrawal rollers 126 not only with respect to the time-related sequence but also with respect to the speed.

For the actual piecing process, the combined clamping and cutting device 62 is first actuated so that the piece of auxiliary yarn blown into the spinning unit 1 is detached and the piece of yarn connected with the auxiliary spool 55 is clamped tight. Subsequently, the pair of auxiliary rollers 126 is closed and driven in withdrawal direction 140 of the yarn so that the auxiliary yarn 67 is withdrawn through the wedge-shaped gap 9. The withdrawing takes place at a withdrawal speed that, compared to the normal spinning operational withdrawal speed, is reduced significantly, for example, by the factor 10, so that a withdrawal speed of a magnitude of 20 to 30 m/min. exists. The now withdrawn yarn, through the still open yarn clamp 125, enters into the suction piece 83 and is sucked off. At predetermined points in time, the auxiliary drives of the feeding roller 4 and of the rollers 7 and 8 are switched on so that the spinning process is started. These points in time are selected in such a way that a yarn piecing is obtained between the auxiliary yarn and the newly formed yarn which represents a safety piecing and ensures the piecing process. For example, it can be proceeded in such a way that the fiber feeding system is switched on by the turning-on of the drive of the shaft 117 before the end of the auxiliary yarn 67 reaches the area of the mouth 19. At an appropriate time previously, the drive of the friction wheel 112 is also switched on. In this manner, a sort of winding yarn is spun first which then changes into pure friction yarn when the end of the auxiliary yarn 67 has passed the area of the mouth 19. At the latest after the yarn piecing is produced, the programmed control system controls the rotating speeds of the shaft 117 and of the friction wheel 112 at a ratio with respect to the withdrawal speed of the pair of auxiliary rollers 126 that is coordinated in such a way that despite the significantly reduced production speed or spinning speed, a yarn with the same yarn count is spun as that obtained in the case of the significantly higher normal spinning operational production speed.

As soon as the auxiliary yarn and the yarn piecing 129 have been sucked into the suction piece 83, the cutting device 89 is actuated so that the auxiliary yarn with the yarn piecing 129 is detached and is removed as waste.

During the above-described steps, a yarn clamp 130 is placed at the thread end that is held by the suction nozzle 104 and unwound from the spool 14, said yarn clamp 130 is carried on a lever 131 to be swivelable around a shaft 132 by means of a motor operator 133 corresponding to the directions of the arrows 134 and 135. By actuating the cutting device 105 combined with the suction nozzle 104, the broken and possibly bad-quality yarn end is cut off. The yarn clamp 130 is then swivelled in the direction of the arrow 134 so that it is opposite the yarn clamp 125 of the yarn storage device. When the now closed yarn clamp 130 is swivelled, the yarn is placed around a thread guide located in the swivel shaft 132. After the actuating of the cutting device 89 of the suction piece 83, the yarn clamp 125 is closed. The suction piece 83 is swivelled away in the direction of the arrow 137 so that now two yarn ends 138 and 139 (FIG. 6) are opposite one another that are held by the clamps 125 and 130. A splicer 144 is placed at these yarn ends 138 and 139 that is provided with a splicing groove 145 receiving the yarn ends 138 and 139. An air connection 146 is connected to this splicer 144. This air connection 146 may first be connected to a vacuum source in order to suck the yarn ends 138 and 139 into the splicing groove 145. Subsequently, in a known manner, via the air pipe, a thrust of compressed air is entered into the splicing groove 145 so that the two yarn ends 138 and 139 are spliced together.

Figure 7:
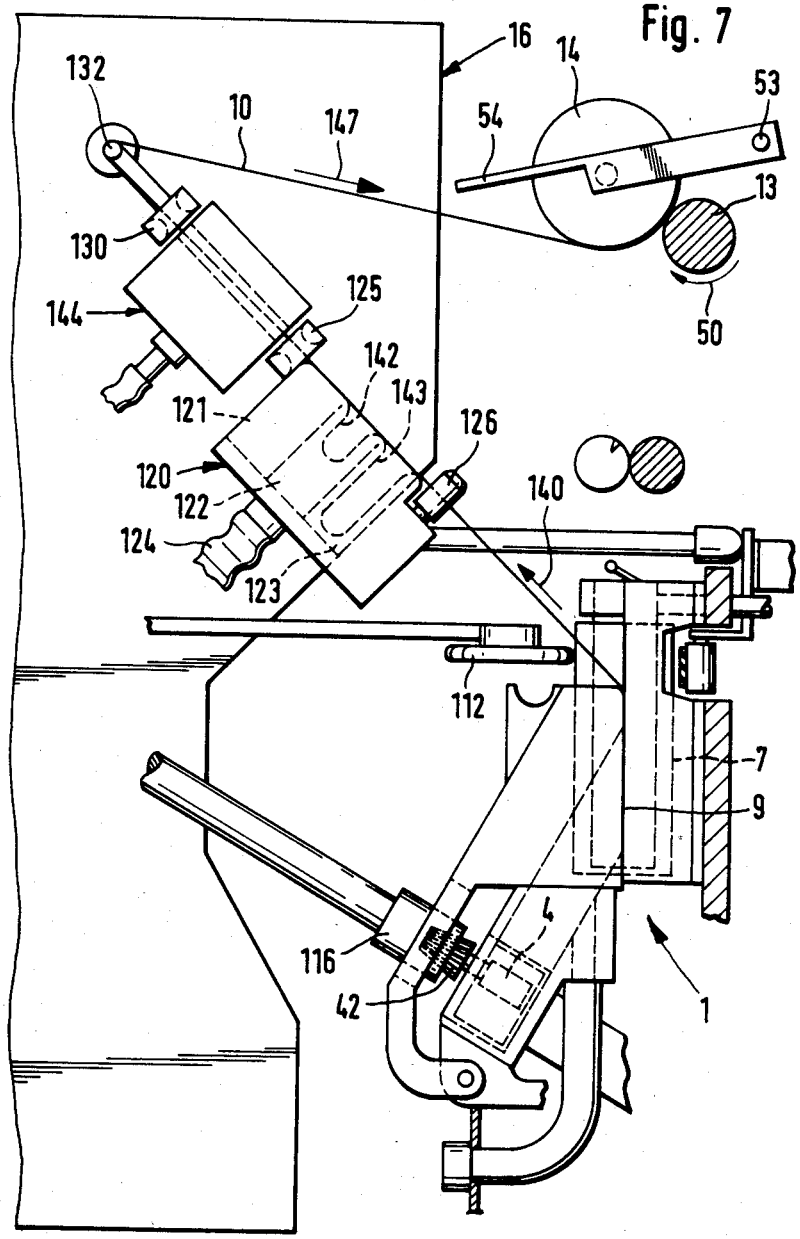

After the making of the splicing connection, the two yarn clamps 130 and 125 are opened immediately. As fast as possible, the wind-up device of the spool 14 is also switched on again. This winding-up takes place at a speed that is as high as possible. For this purpose, the spool lifting roller 97 is first switched in wind-up direction of the spool 14, and subsequently, the spool is placed on the grooved roller 13. The yarn produced during the time period in which the yarn clamp 125 was closed is stored temporarily in the yarn storage device 120. In this case, the yarn storage device 120 is controlled in such a way that the chamber 121 located closest to the yarn clamp 125 is first acted upon by the vacuum, so that a yarn loop 141 is first formed here. Then the vacuum chamber 122 and subsequently the vacuum chamber 123 are acted upon by the vacuum so that loops 142 and 143 may form. After the opening of the yarn clamps (FIG. 7) 125 and 130 and the turning-on of the wind-up device, the vacuum in the chamber 121 closest to the yarn clamp 125 is first cancelled or reduced so that first the loop 141 located in this chamber 121 will open up. Then, by means of the turning-off or the reduction of the suction effects in the chambers 122 and 123, the subsequent loops 142 and 143 will be opened up.

The drives of the pair of auxiliary rollers 126, of the friction wheel 112 and of the shaft 116 are, while being controlled by the programmed control system, run up to the operational values, in which case a coordination takes place to the extent that also during this phase, a yarn with a yarn count of the operationally spun yarn is produced. It is useful when the running-up to the normal operating speed takes place with a time delay after the switching-on of the wind-up device so that the yarn storage device 120 is emptied rapidly. In this case, it is provided that the reaching of the operational production speed coincides approximately with the emptying of the yarn storage device 120. After the operational production speed is reached, the drives on the machine side for the feeding roller 4 and the rollers 7 and 8 will start to be used again. For this purpose, the thrust piece 93 is moved back in the direction of the arrow 96 (FIG. 8), so that the tangential belt 24 is again pressed against the rollers 7 and 8 and takes over their drive. In addition, the shaft 117 with the coupling piece is withdrawn, in which case the operational drive is switched back on. In this case, it should be observed that the position of the individual devices within the servicing apparatus 16 in FIGS. 4 to 8 is not indicated precisely for reasons of representation. In particular, the auxiliary withdrawal rollers 126 are in fact arranged in such a way that they have a withdrawal direction in longitudinal direction of the wedge-shaped gap 9 corresponding to the withdrawal direction of rollers 11, 12 of the spinning unit 1, as shown in FIG. 8A. As a result, the yarn feeler 48 is already brought into its operating position at the start of the piecing process. The servicing apparatus 16 is equipped with a device that is not shown that is applied to the yarn feeler switch and for the period of the piecing process switches it in such a way that the coupling to the feeding roller 4 remains open.

Figure 8:
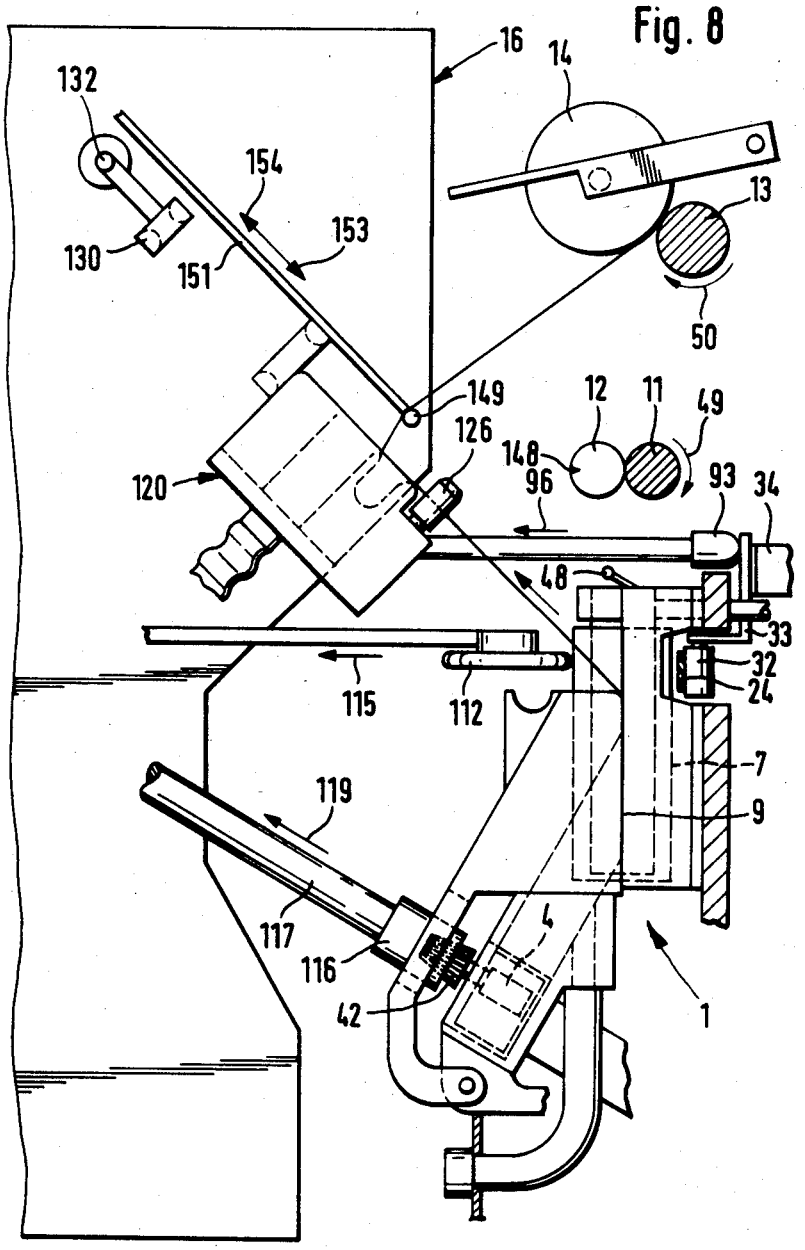
Figure 8A:
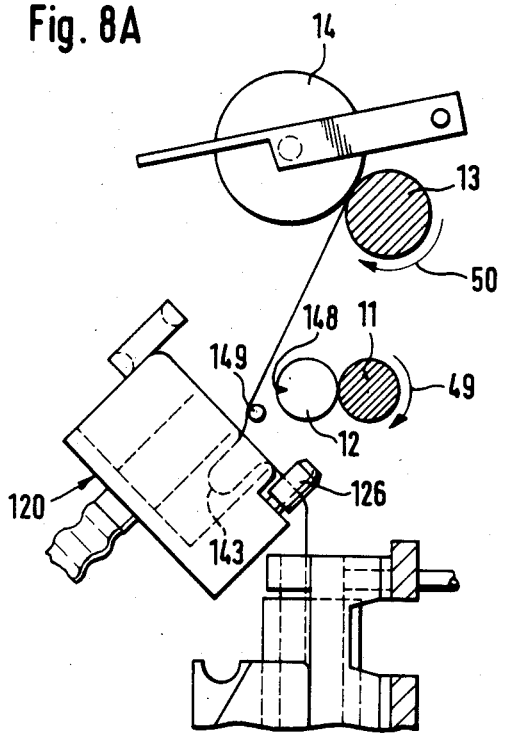

During the emptying of the yarn storage device 21, a yarn transfer strap 149 of the servicing apparatus 16 that can be moved on a rod 151 in the direction of the arrows 153 and 154 lifts the moving yarn off the guide corresponding to the swivel shaft 132 and transfers the yarn into the area of the storage device 120 and thus of the pair of auxiliary rollers 126 (FIG. 8). When the last yarn loop 143 is emptied out of the yarn storage device 120, the transfer strap 149 reaches a position in which the yarn reaches the circumference of the single pressure roller 12 (FIG. 8A). This single pressure roller 12, on the front side, is provided with a notch 148, in the area of which the yarn will arrive because of the to-and-fro movement of the grooved drum 13, after which it is automatically placed in the clamping gap between the bottom roller 11 and the individual pressure roller 12. At this point in time, the pair of auxiliary rollers 126 will then also be opened. The piecing process is then concluded so that the servicing apparatus 16 can resume its monitoring drive.

It should also be mentioned that the supply of compressed air 65 (FIG. 4) is switched off when the suction piece 83 has taken over the end 68 of the auxiliary yarn 67. At the latest, after the cutting of the auxiliary yarn 67 (FIG. 5), the connection 66 may also be detached from connection 39 of the spinning unit 1.

Figure 6:
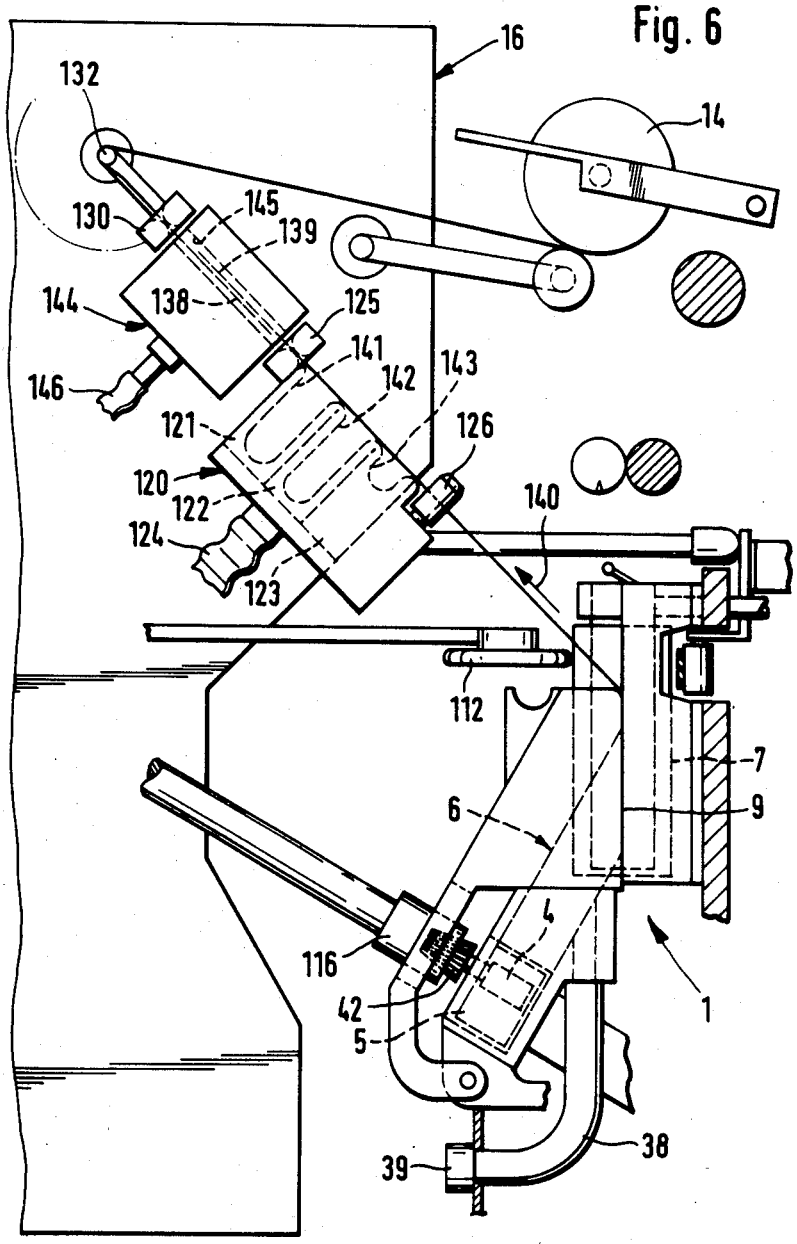

In order to facilitate the work of the splicer 144 (FIG. 6) and to possibly simplify the splicer 144, it can be provided, as a modification of FIG. 6, that, before the splicer 144 is placed, the yarn clamps 125 and 130 are moved in moving direction of the yarn and against the moving direction of the yarn, while taking along the clamped-in yarns, in such a way that they exchange their position. Two taut yarn ends will then exist that run parallel to one another, to which the splicing groove 145 of the splicer 144 can then be assigned. The splicer 144 must then be provided with suitable cutting devices, by means of which it will cut the yarn ends to a shape that is suitable for the splicing connection.

Advantageously, the servicing apparatus 16 will be provided with a device for the cleaning of the rollers 7 and 8, which is applied before the actual piecing process since in many cases a dirtying of the rollers 7 and 8 is the cause of a yarn breakage. For the cleaning process, while the spinning unit 1 is opened, i.e., through the partial housing 18 being swivelled away by the servicing apparatus 16, a cleaning roller 159 (FIG. 9) is placed that runs in parallel to the wedge-shaped gap 9. This cleaning roller is arranged on a suction pipe 160 and is provided with bristles in the manner of a brush. The shell surface of the cleaning suction roller 159 is connected to the suction pipe 160 via relatively large holes 136. The suction roller 159 may be provided with a drive which drives it against the normal rotating direction of the rollers 7 and 8, so that a correspondingly strong brushing effect is achieved. It is advantageous, when during this period of time the drive of the rollers 7 and 8 is interrupted by actuating the thrust piece 93. If necessary, the drive may also, by means of a repeated to-and-fro movement of the thrust piece 93 corresponding to the direction of the arrows 95 and 96, be switched on again for a short period of time so that the rollers 7 and 8 are driven in their normal driving direction at a low rotating speed.

In the subsequent description of the other embodiments, the same reference numbers as in the preceding embodiments are used if they are corresponding components. These components will then not be described again. Reference is made in this respect to the corresponding preceding description.

Figure 9:
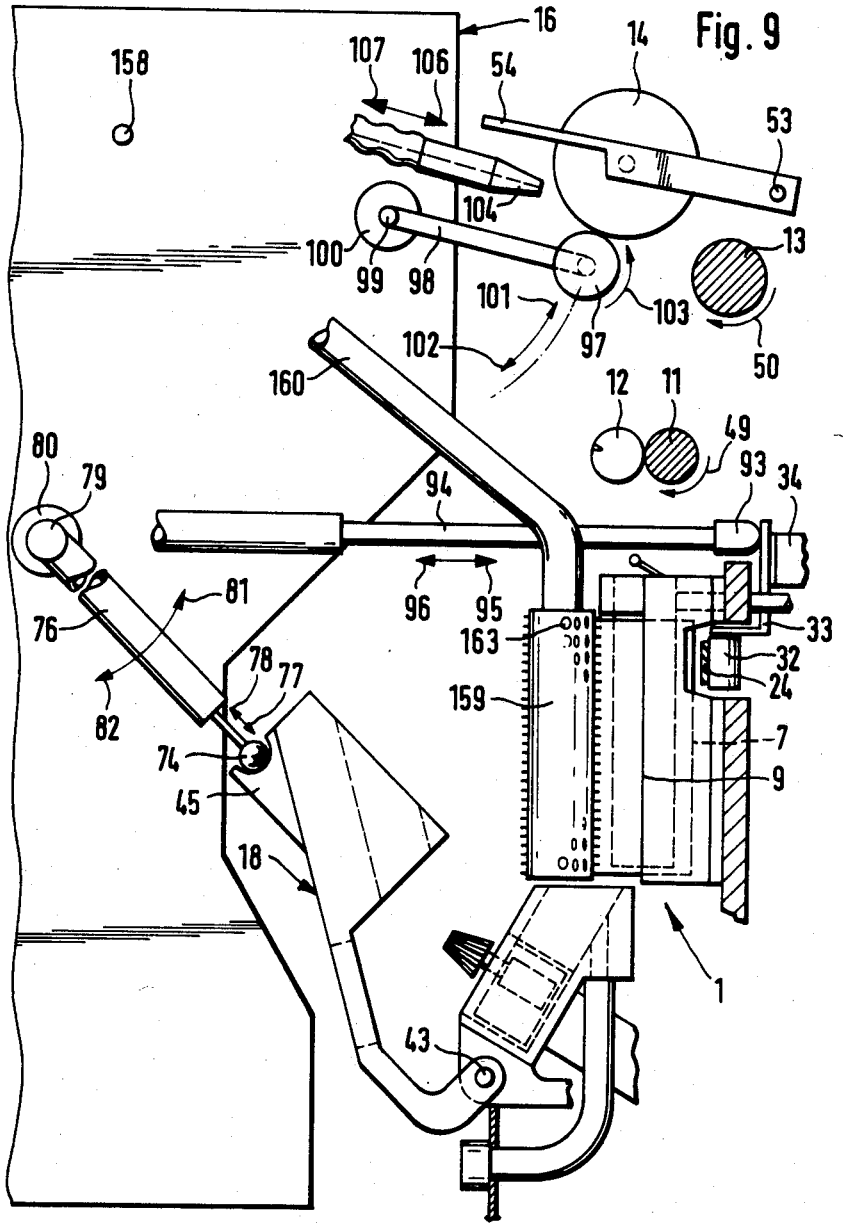
FIGS. 9 to 12 are schematic sectional views depicting the positioning of the operational elements of a spinning unit and a mobile servicing unit during various stages of a piecing and winding operation, according to a further preferred embodiment of the invention.
Figure 10:
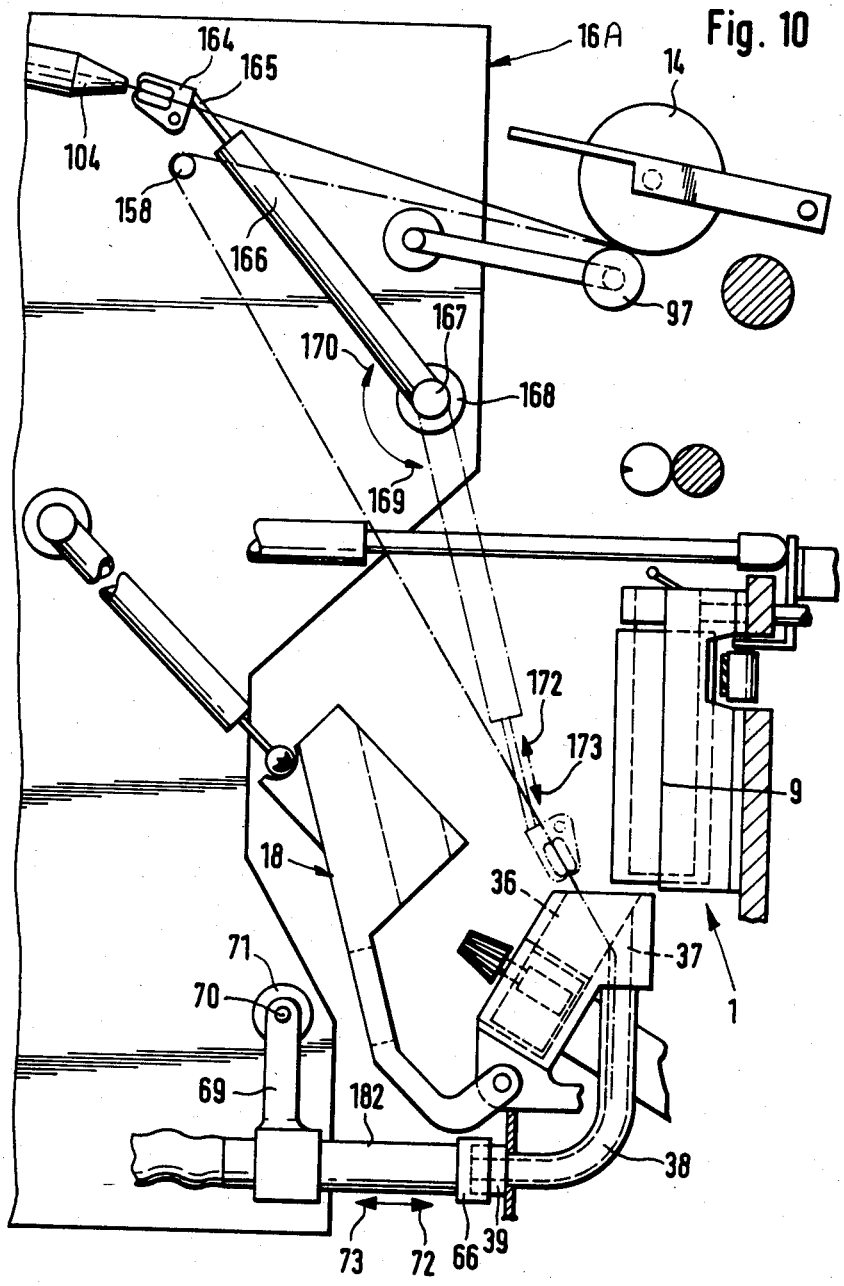
Figure 11:
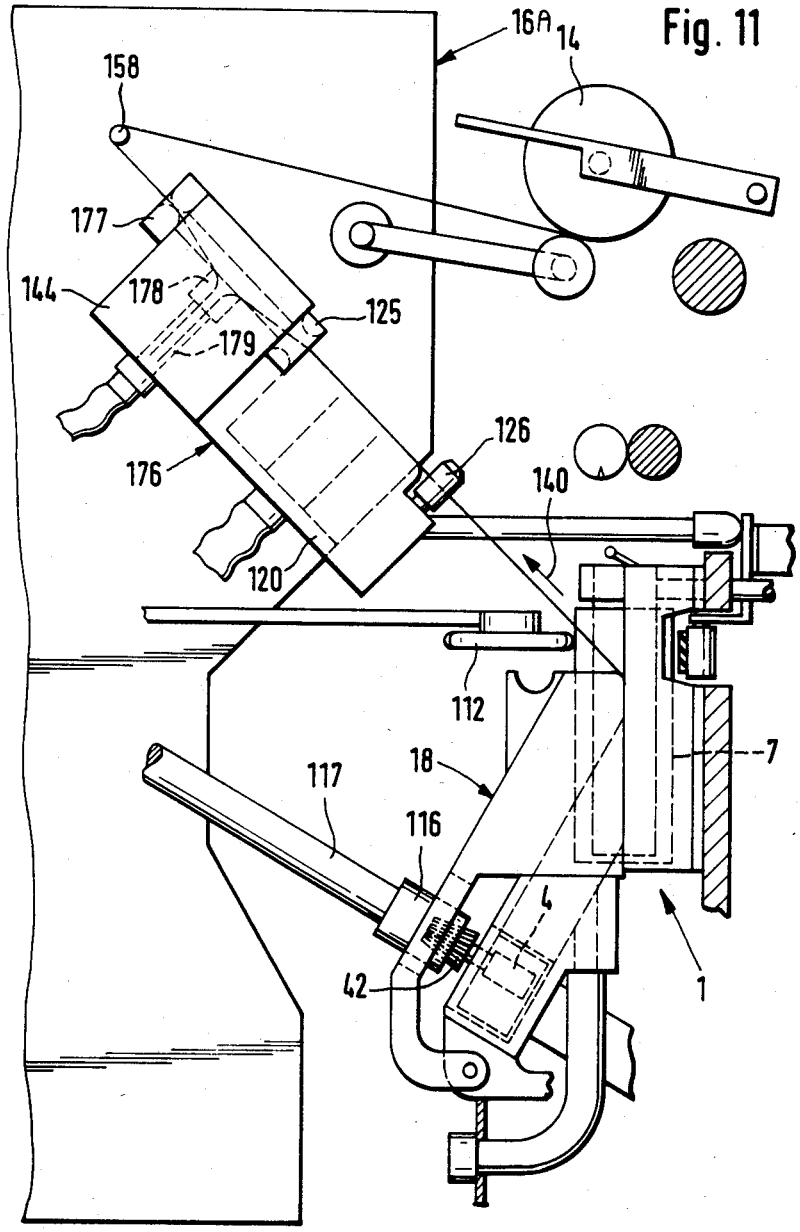
Figure 12:
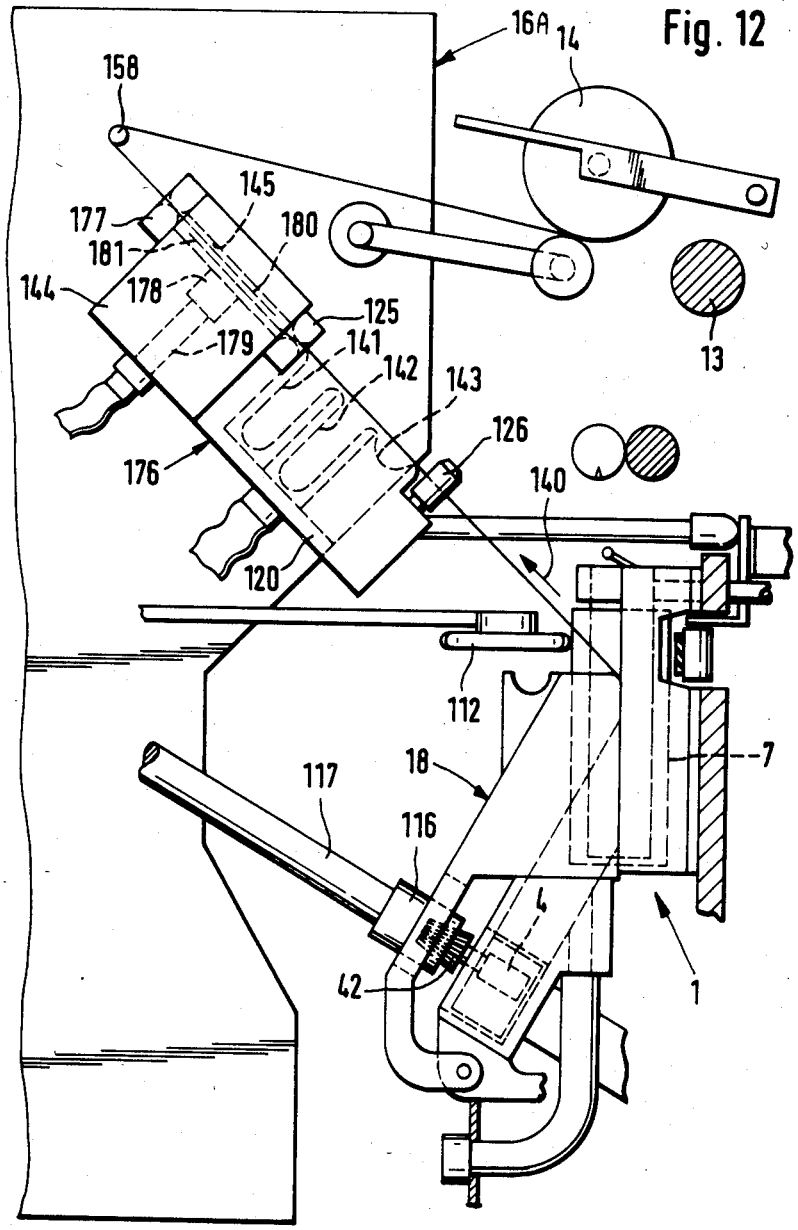

The embodiment according to FIGS. 10 to 12 differs from the embodiment according to FIGS. 4 to 8A basically because of the fact that no auxiliary yarn is used but that the yarn unwound from the spool 14 is returned into the spinning unit 1 and by means of a yarn piecing is first pieced with the new yarn. As shown in FIG. 9, in the case of this embodiment, the spool 14 is first lifted off the grooved roller 13 by means of a spool lifting roll 97. Then the suction nozzle 104 is placed which searches for the broken yarn end while, at the same time, the spool 14 is driven in unwinding direction. A yarn clamp 164 (FIG. 10) is then placed at the suction nozzle 104 returned to its initial position, said yarn clamp 164 grasping the returned yarn end that was preferably shortened to a predetermined length. The yarn clamp 164 is arranged on a yarn transfer lever 166 that can be swivelled around shaft 167 by means of a motor operator 168 corresponding to the direction of the arrows 169 and 170. A roll 165 can be moved out of the yarn transfer lever 166 which carries the yarn clamp 164. While the yarn is unwound from the spool 14 by means of the spool lifting roll 97, the yarn clamp 164 is swivelled into the position shown by dash-dotted lines in FIG. 10. In this case, the yarn clamp 164 places the yarn around a yarn guide 158 and offers the yarn end 175 to the mouth of the channel 37. The servicing apparatus 16 places a suction pipe 182 having a connection 66 at the connection 39 of the spinning unit 1 which, via an elbow 38, is connected with the channel 37, said suction pipe 182 being held by a holder 69 that can be swivelled and serves to generate a suction air flow in the area of the mouth of the channel 37. The yarn clamp 164 is opened. The spool lifting roll 97 continues to unwind a certain length of yarn so that an indicated yarn length is sucked into the channel 37. Then the yarn clamp 164 is withdrawn. A taut piece of yarn will then be located between the yarn guide 158 and the opening roller housing 35. The partial housing 18 is then closed by the servicing apparatus 16 in which case the yarn arrives in part 44 of the fiber feeding channel 6 of the partial housing 18 and in the wedge-shaped gap 9 of the rollers 7 and 8. Then the connection 66 having the suction pipe 182 will be withdrawn from the spinning unit 1.

Subsequently, auxiliary drives are placed at the spinning unit 1, i.e., the shaft 117 having the coupling piece 116 is fitted on the bevel wheel 42 of the feeding roller and the friction wheel 112 extends between the two rollers 7 and 8 and is pressed against them (FIG. 11). A constructional unit 176 is applied to the yarn guided in the servicing apparatus 16A, said constructional unit 176 consisting of a yarn storage device 120 and a splicer 144. At the entrance of the yarn storage device 120, the auxiliary withdrawal rollers 126 are arranged. The yarn clamp 125 is located at the outlet side. Behind the splicer 144 in moving direction of the yarn 140, another yarn clamp 177 is arranged. The splicer 144 contains a suction device 179, in the area of which a cutting device 178 is arranged.

During the piecing process which takes place in the same way as in the case of the above explained embodiment of FIGS. 4–8, the winding-on device of the spool 14 is stopped. The yarn clamp 177 is closed. The yarn withdrawn by the pair of auxiliary withdrawal rollers 126 is sucked into the suction device 179 in the form of a loop. After a predetermined point in time, the yarn piecing is located between the returned yarn and the newly spun yarn within the suction device 179. At this point in time, the yarn clamp 125 is closed so that the further produced yarn is stored in the yarn storage device 120 (FIG. 12). At the same time, the cutting device 178 is actuated, after which two splicable yarn ends 180 and 181 are available which are twisted and spliced together with one another in the splicing groove (145). After the splicing connection is made, the yarn clamps 125 and 177 are opened, while the winding-on device of the spool 14 is also turned on again. The continuation of the process is carried out in the same way by the servicing apparatus 16A as it was explained for servicing apparatus 16 in FIGS. 7 to 8A.

Figure 13:
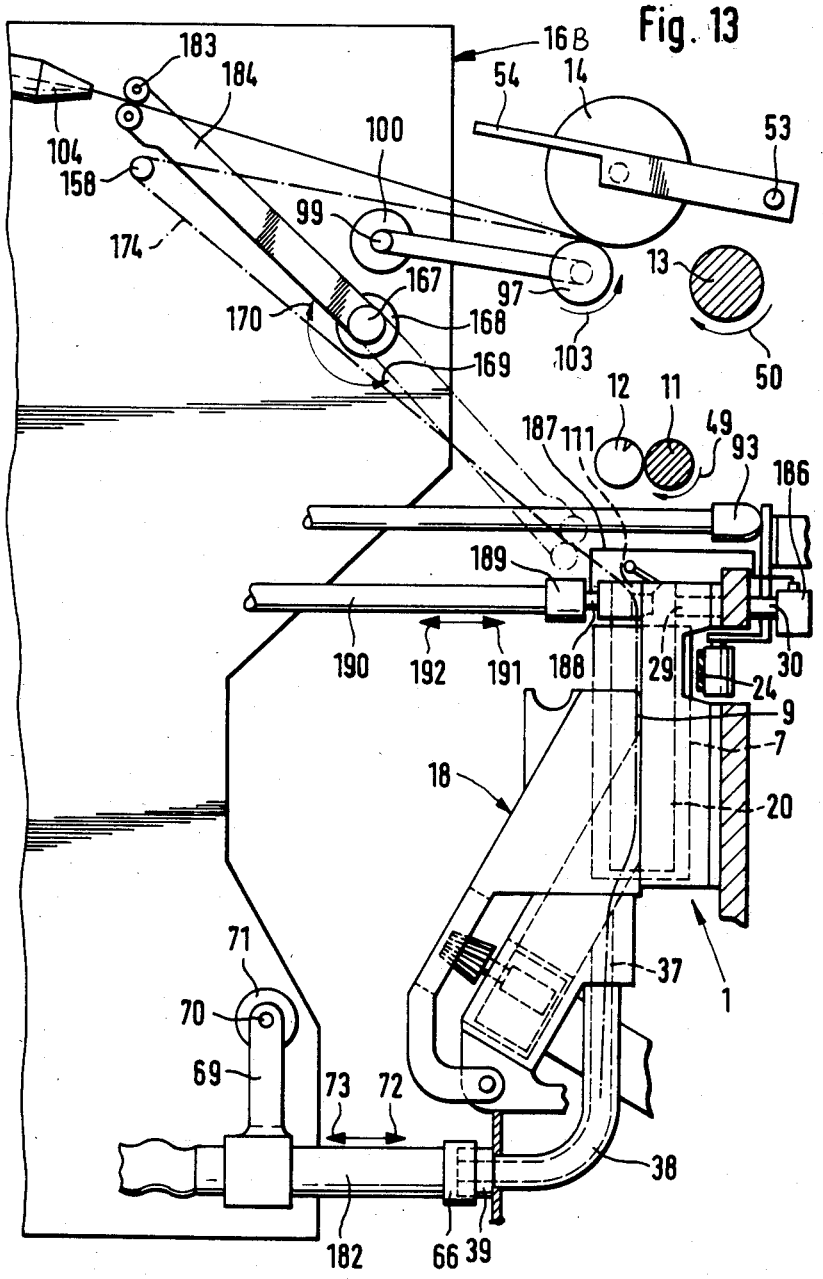
FIG. 13 is a schematic sectional view of a spinning unit and a servicing unit, showing a further embodiment of the present invention.
Figure 14:
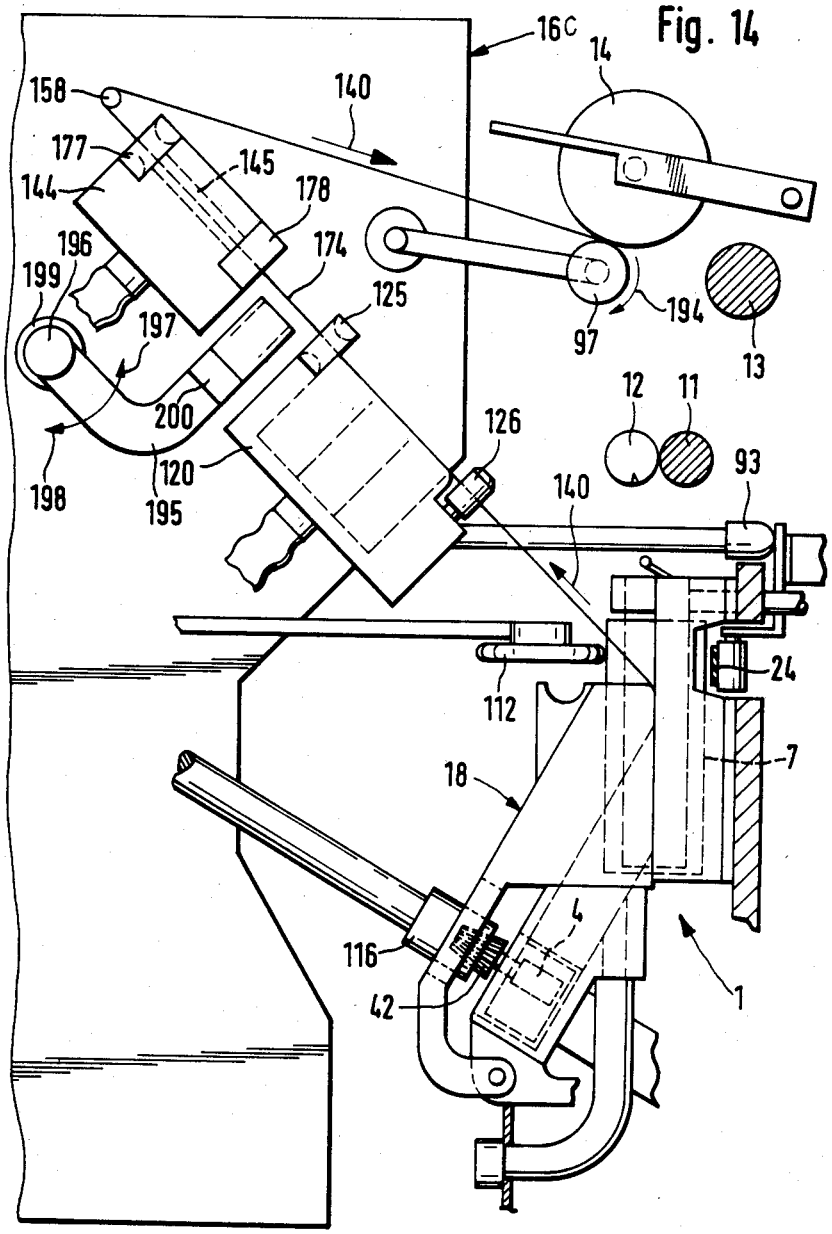
FIGS. 14–18 are schematic sectional views depicting the positioning of the operational elements of a spinning unit and a mobile servicing unit during various stages of a piecing and winding operation, according to a yet further preferred embodiment of the invention.

In the case of the servicing apparatus 16B of the embodiment according to FIG. 13, similarly to the embodiment according to FIGS. 9 to 12, a yarn end is taken from the spool 14 and is entered into the spinning unit 1 for piecing. The yarn end is grasped by a pair 183 of clamping rollers of a yarn transfer lever 184 at the suction nozzle 104 and, by means of the swivelling of the yarn transfer lever 184 around the swivel shaft 167 by means of a motor operator 168, is swivelled into the dash-dotted position corresponding to the directions of the arrows 169 and 170, in which the free yarn end is opposite a yarn withdrawal tube 111 of the spinning unit 1. The yarn end is then sucked into the closed spinning unit 1 via a channel 37, the connection elbow 38 and the suction pipe 182 of the servicing apparatus 16. Before this sucking-in process, the drive of the rollers 7 and 8 is interrupted by means of the thrust piece 93 of the servicing apparatus 16B, which in the above-described manner, ensures that the tangential belt 24 is detached from the rollers 7 and 8. While the spool lifting roll 97 is actuated in unwinding direction 103 of the spool 14, the yarn end is returned into the elbow 38 while the clamping rollers are actuated at the same time.

In the case of the embodiment according to FIG. 13, in contrast to the preceding embodiments, the friction effect of the rollers 7 and 8 during the piecing process, i.e., during the making of the yarn piecing until the running-up to the operational production speed, is controlled by the fact that the suction effect of the inserts 20 and 21 is throttled. For this purpose, a throttle valve 186 is arranged in the vacuum pipe 30 which, via the connecting channel 29, is connected with the inside of the suction inserts 20 and 21, said throttle valve 186, via a pipe 187, being connected with an actuating element 188 arranged on the front side of the spinning unit 1. A tappet 189, 190 of the servicing apparatus 16B is applied to this actuating element 188, said tappet 189, 190 being movable in the direction of the arrows 191 and 192. The position of the tappet 189, 190 is controlled by the programmed control system in coordination with the not shown auxiliary drive for the feeding roller and the auxiliary withdrawal rollers in such a way that during the piecing, while the splicing connection is made and during the subsequent running-up, a yarn count is spun that corresponds to the operational yarn count. In this case, it may also be provided that the pair of clamping rollers 183 is equipped with a continuously controllable drive in the withdrawal direction so that this pair of clamping rollers 183 is used as the auxiliary pair of withdrawal rollers. During the piecing, i.e., for producing the yarn piecing and during the continuation of the process, the operational drive of the rollers 7 and 8 is switched back on by withdrawing the thrust piece 93 so that the tangential belt 24 is pressed against the rollers 7 and 8 and drives them.

In order to control the friction effect of the rollers 7 and 8 during the piecing not only via the suction effect or the rotating speed of the rollers 7 and 8, it is also contemplated to provide that the throttling of the suction effect of the suction inserts 20 and 21 takes place in connection with an auxiliary drive via a friction wheel 112 during the piecing. In this case, before the piecing, a friction wheel 112 is applied to the rollers 7 and 8, in which case, at the same time, the thrust piece 93 is held in the indicated position so that the operational drive of the rollers 7 and 8 remains interrupted by the lifting-off of the tangential belt 24. By means of the combination of these two measures, the friction effect of the rollers 7 and 8 can be controlled sensitively, in particular, a balancing may also take place that the friction effect for obtaining the same yarn count, in the case of varying production speeds, cannot be achieved by a linear change of rotating speed of the rollers 7 and 8.

In the case of the embodiment according to FIGS. 14 to 18, the servicing apparatus 16C, for example, corresponding to the embodiment according to FIGS. 10 or 13, introduces a yarn end unwound from the spool 14 into the spinning unit 1. In the travel direction of the yarn, a yarn storage device 120 having a pair of auxiliary withdrawal rollers 126 in front of it and having a yarn clamp 125 behind it, a suction piece 195 and a splicer 144 are first applied to the piece of yarn stretched between the spinning unit 1 and the yarn guide 158. In the proximity of its entrance, the suction piece 195 is provided with a cutting device 200. At the entrance side of the splicing groove 145, the splicer 144 has a cutting device 178, and at its outlet side, the splicer has a yarn clamp 177.

Figure 15:
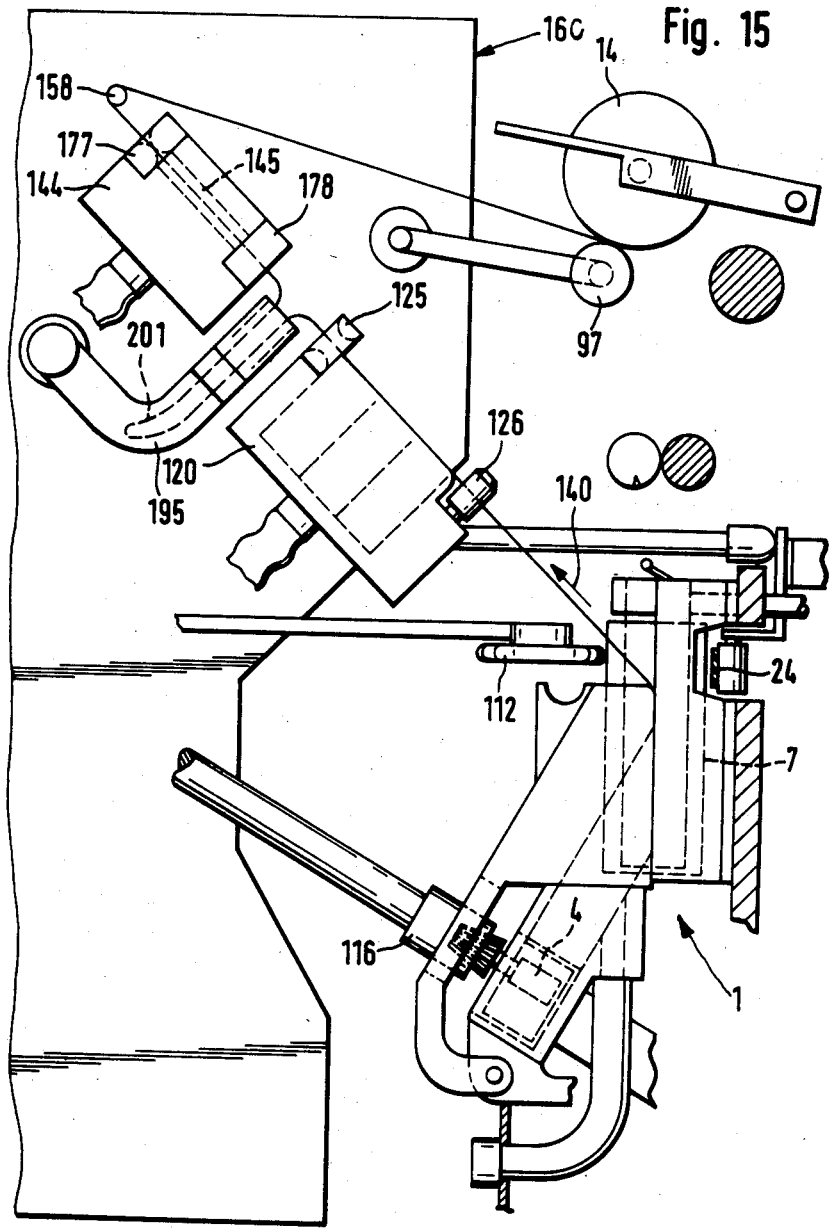
Figure 16:
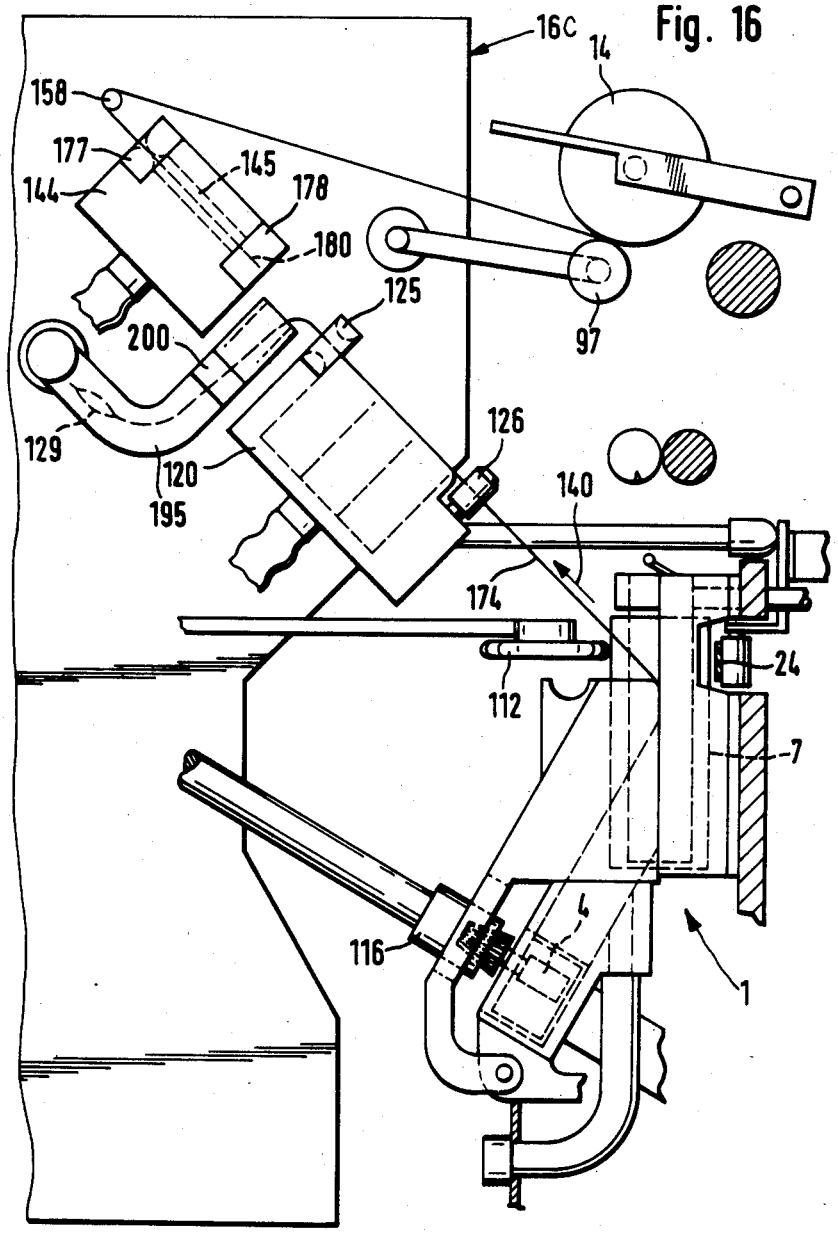

The first step of the piecing process, namely the production of a yarn piecing between the returned yarn and the newly to be spun yarn, takes place in the way explained by means of FIGS. 4 to 8. However, in contrast to that process, with the switching-on of the auxiliary withdrawal rollers 126, by switching on the spool lifting roll 97 in wind-up direction, the yarn is wound onto the spool 14 at a wind-up speed that is reduced corresponding to the withdrawal speed. As soon as the yarn piecing reaches the area of the yarn storage device 120, which can be determined by means of a time element of the programmed control system or by means of a detector, the drive of the spool 14 is interrupted and the yarn clamp 177 is closed. In addition, at the latest now, the vacuum is applied to the suction piece 195. The further produced yarn is now sucked into the suction piece 195 in the shape of a loop (FIG. 15). Then the cutting device 178 of the splicer 144 is actuated (FIG. 16) so that a free yarn end 180 is located in it.

Figure 17:
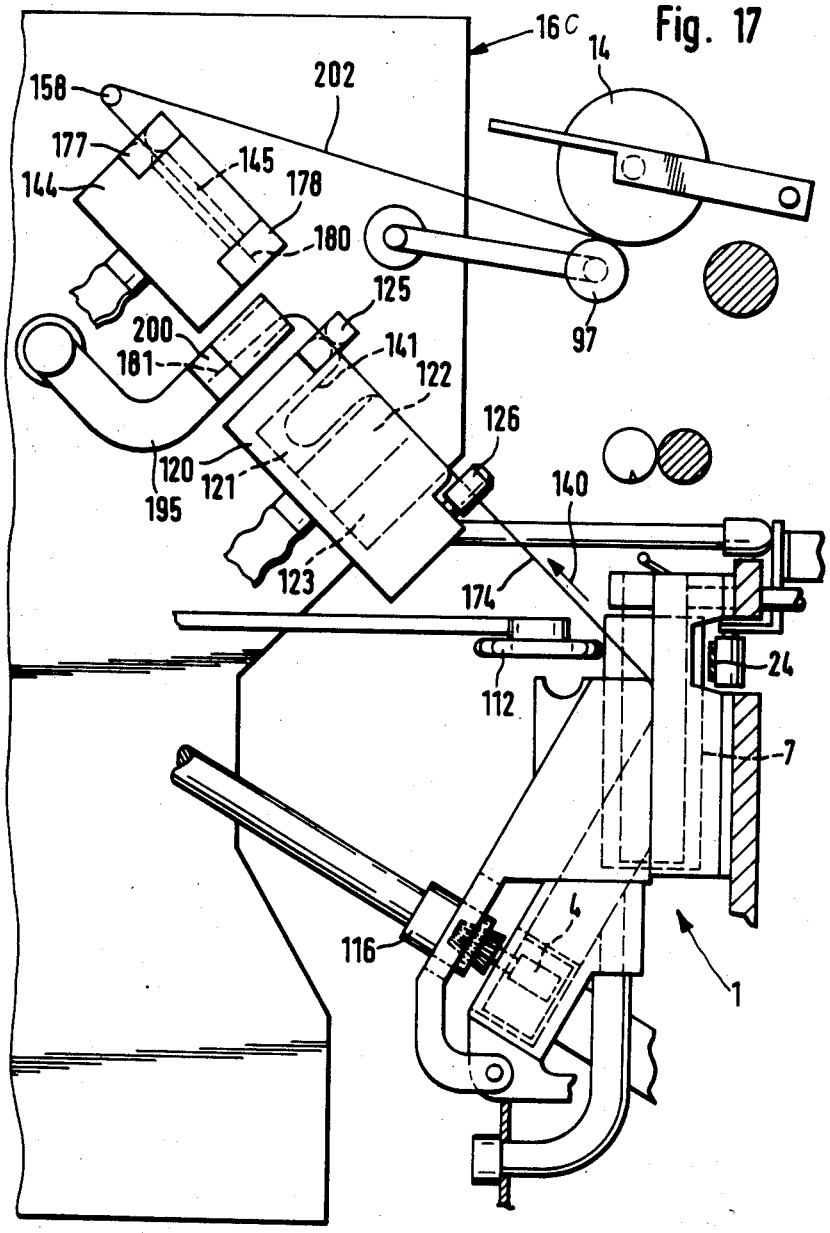
Figure 18:
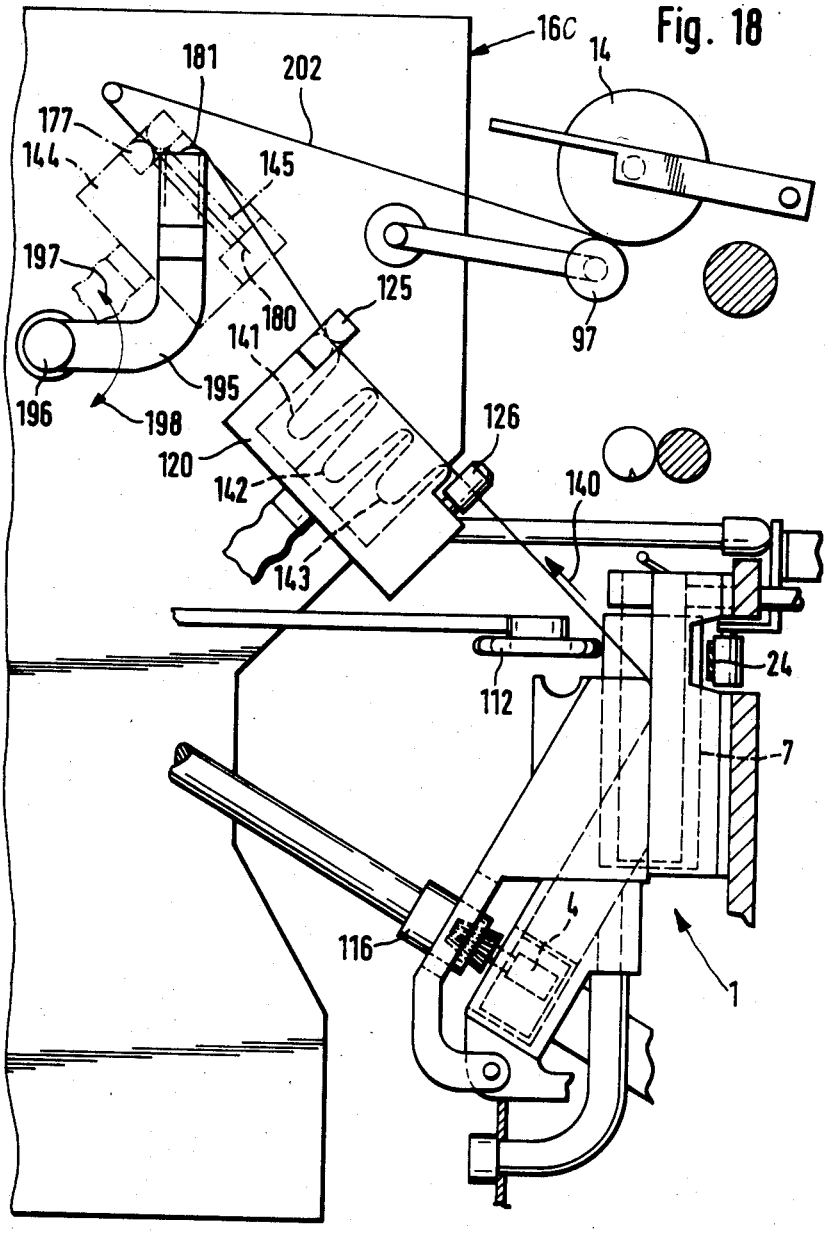

Then the cutting devices 200 of the suction piece 195 are actuated and the yarn clamp 125 is closed (FIG. 17). The cut-off yarn piece with the yarn piecing 129 is sucked into the waste. The further produced yarn, in loops 141, 142, 143 is received in the chambers 121, 122, 123 of the yarn storage device (FIG. 18). After the actuating of the cutting device 200, the suction piece, by means of a motor operator is swivelled around the shaft 196 in the direction of the arrow 197, placing the yarn end clamped by the yarn clamp 125 in the splicing groove 145. The two yarn ends 180 and 181 which, coming from opposite directions, are located next to one another in the splicing groove 145, are then connected with one another by a splicing connection. After the splicing connection is made, the yarn clamps 177 and 127 are opened, and the wind-up device for winding the yarn on the spool 14 is switched on. The process steps that are carried out in this case, are described in the statements regarding FIGS. 7 and 8.

As a modification of the embodiment according to FIGS. 4 to 8, the same process sequence may essentially also be achieved according to another arrangement contemplated by the invention, wherein an auxiliary spool 55 is not used. In this case, by means of a suitable thread guide, the yarn end withdrawn from the spool 14 is applied to the injection pipe 61 from which it is then, in the described way inserted in withdrawal direction, in the wedge-shaped gap 9 of the spinning unit 1. During the placing or applying movement, the yarn end may then already be guided via the splicer 144 and may be cut off at its end by a cutting device, so that, on the one hand, a spliceable yarn end is inserted, while on the other hand, a yarn end of a certain yarn length is available for the piecing.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Piecing apparatus for piecing a yarn at an open-end friction spinning unit of the type having at least one spinning unit operable at a normal operating speed with:

drivable friction surface means defining a yarn formation zone, driving means for driving the friction surface means, fiber feeding means for feeding separated fibers to the yarn formation zone, yarn withdrawal means for withdrawing formed yarn from the yarn formation zone, suction means for applying suction forces to the yarn formation zone, and yarn winding means for winding the spun yarn on a spool, said piecing apparatus comprising:

yarn end inserting means for inserting a yarn end into the spinning unit, friction effect control means for controlling the friction effect of the friction surface means, fiber feed control means for controlling the quantity of fed fibers, yarn end withdrawal means for withdrawing the yarn end and attached piecing with newly spun yarn, piecing section cut out means for cutting out the piece of yarn containing the yarn piecing, splicing means for making a splicing connection between the newly formed yarn end and a yarn end connected with the spool, adjusting means for selectively reducing the spinning unit operating speed to a speed below the normal operating speed during the making of a splicing connection by the splicing means, yarn storage device means for temporarily storing the newly formed yarn during the making of a splicing connection by the splicing means, winding control means for controlling the winding onto the spool, and program control means for controlling the individual operating means such that the formation of the yarn piecing and splicing connection occurs at a lower production speed as compared to normal spinning operation, said program control means including means for controlling the individual operating means such that, after the formation of the splicing connection, winding takes place at a speed exhibiting a difference, with respect to the speed of the yarn end withdrawal means for piecing, which is larger than the difference between the winding and yarn withdrawal speeds during the normal spinning operations, said yarn storage device means being subdivided in the travel direction of the yarn into several chambers located one behind the other, which chambers are selectively connectable to a vacuum source.

2. Apparatus according to claim 1, wherein the yarn device means contains a switching element for successively connecting the chambers to the vacuum source and for separating the same from the vacuum source.

3. Piecing apparatus for piecing a yarn at an open-end friction spinning unit of the type having at least one spinning unit operable at a normal operating speed with:

drivable friction surface means defining a yarn formation zone, driving means for driving the friction surface means, fiber feeding means for feeding separated fibers to the yarn formation zone, yarn withdrawal means for withdrawing formed yarn from the yarn formation zone, suction means for applying suction forces to the yarn formation zone, and yarn winding means for winding the spun yarn on a spool, said piecing apparatus comprising:

yarn end inserting means for inserting a yarn end into the spinning unit, friction effect control means for controlling the friction effect of the friction surface means, fiber feed control means for controlling the quantity of fed fibers, yarn end withdrawal means for withdrawing the yarn end and attached piecing with newly spun yarn, piecing section cut out means for cutting out the piece of yarn containing the yarn piecing, splicing means for making a splicing connection between the newly formed yarn end and a yarn end connected with the spool, adjusting means for selectively reducing the spinning unit operating speed to a speed below the normal operating speed during the making of a splicing connection by the splicing means, yarn storage device means for temporarily storing the newly formed yarn during the making of a splicing connection by the splicing means, winding control means for controlling the winding into the spool, and program control means for controlling the individual operating means such that the formation of the yarn piecing and splicing connection occurs at a lower production speed as compared to normal spinning operation, said program control means including means for controlling the individual operating means such that, after the formation of the splicing connection, winding takes place at a speed exhibiting a difference, with respect to the speed of the yarn end withdrawal means for piecing, which is larger than the difference between the winding and yarn withdrawal speeds during the normal spinning operations, said spinning units each being equipped with a channel which leads into the area of the yarn formation zone facing away from the yarn withdrawal means, said channel being selectively connectible to an air supply connection of the servicing unit.

4. Apparatus according to claim 3, wherein the channel is arranged in a housing surrounding an opening roller of the fiber feeding means.

5. Apparatus according to claim 3, wherein the servicing unit is equipped with broken yarn end seeking means for seeking and receiving the broken yarn end wound on the spool, with means for the return of the yarn end to the spinning unit, and with a vacuum connection that can be connected to the channel.

6. Apparatus according to claim 3, wherein the servicing unit is equipped with broken yarn end seeking means for seeking and receiving the broken yarn end wound on the spool, with inserting means for inserting the yarn end in the splicing means, with means for feeding a yarn end taken from an auxiliary spool arranged in the servicing unit to the channel of the spinning unit, with means for introducing this yarn end into the yarn formation zone of the spinning unit, with said yarn end withdrawal means, with means for detaching the yarn end with the yarn piecing, and with means for placing the newly formed yarn without the yarn piecing in the splicing means.

7. Apparatus according to claim 3, wherein the servicing unit is equipped with broken yarn end seeking means for seeking and receiving of broken yarn end wound on the spool, with means for the feeding of this yarn end to the channel of the spinning unit, with means for introducing this yarn end into the yarn formation zone, with means for the cutting into length of an indicated piece of yarn, with means for placing the remaining yarn end connected with the spool in the splicing means, with the yarn end withdrawal means for the withdrawal of the yarn end inserted into the yarn formation zone and of the new yarn pieced by means of a yarn piecing, with means for detaching the yarn end with the yarn piecing, and with means for placing the newly formed yarn without the yarn piecing in the splicing.

8. Piecing apparatus for piecing a yarn at an open-end friction spinning unit of the type having at least one spinning unit with:

a pair of friction rollers arranged adjacent one another to form a wedge-shaped yarn forming gap, friction roller driving means for driving the friction rollers in the same rotational direction during spinning operations, fiber feeding means for feeding separated fibers to the yarn forming gap, yarn withdrawal means for withdrawing formed yarn from the yarn forming gap, suction means for applying suction forces to the yarn forming gap, and yarn winding means for winding the spun yarn on a spool, said piecing apparatus comprising:

yarn end inserting means for inserting a yarn end into the spinning unit, friction effect control means for controlling the friction effect of the rollers, fiber feed control means for controlling the quantity of fed fibers, yarn end withdrawal means for withdrawing the yarn end and attached piecing with newly spun yarn, piecing section cut out means for cutting out the piece of yarn containing the yarn piecing, splicing means for making a splicing connection between the newly formed yarn end and a yarn end connected with the spool, yarn storage device means for temporarily storing the newly formed yarn during the making of a splicing connection by the splicing means, winding control means for controlling the winding onto the spool, and program control means for controlling the individual operating means such that the formation of the yarn piecing and splicing connection occurs at a lower production speed as compared to normal spinning operation, said control means including means for controlling the individual operating means such that, after the formation of the splicing connection, winding takes place at a speed exhibiting a difference, with respect to the speed of the yarn end withdrawal means for piecing, which is larger than the difference between the winding and yarn withdrawal speeds during the normal spinning operations, said yarn storage device means being subdivided in the travel direction of the yarn into several chambers located one behind the other, which chambers are selectively connectable to a vacuum source.

9. Piecing apparatus for piecing a yarn at an open-end friction spinning unit of the type having at least one spinning unit with:

a pair of friction rollers arranged adjacent one another to form a wedge-shaped yarn forming gap, friction roller driving means for driving the friction rollers in the same rotational direction during spinning operations, fiber feeding means for feeding separated fibers to the yarn forming gap, yarn withdrawing means for withdrawing formed yarn from the yarn forming gap, suction means for applying suction forces to the yarn forming gap, and yarn winding means for winding the spun yarn on a spool, said piecing apparatus comprising:

yarn end inserting means for inserting a yarn end into the spinning unit, friction effect control means for controlling the friction effect of the rollers, fiber feed control means for controlling the quantity of fed fibers, yarn end withdrawal means for withdrawing the yarn end and attached piecing with newly spun yarn, piecing section cut out means for cutting out the piece of yarn containing the yarn piecing, splicing means for making a splicing connection between the newly formed yarn end and a yarn end connected with the spool, yarn storage device means for temporarily storing the newly formed yarn during the making of a splicing connection by the splicing means, winding control means for controlling the winding onto the spool, and program control means for controlling the individual operating means such that the formation of the yarn piecing and splicing connection occurs at a lower production speed as compared to normal spinning operation, said program control means including means for controlling the individual operating means such that, after the formation of the splicing connection, winding takes place at a speed exhibiting a difference, with respect to the speed of the yarn end withdrawal means for piecing, which is larger than the difference between the winding and yarn withdrawal speeds during the normal spinning operations, said spinning units being each equipped with a channel which leads into the area of the wedge-shaped gap facing away from the yarn withdrawal means, said channel being selectively connectible to an air supply connection of the servicing unit.

10. Apparatus according to claim 9, wherein the channel is arranged in a housing surrounding an opening roller of the fiber feeding means.

11. Apparatus according to claim 9, wherein the servicing unit is equipped with broken yarn end seeking means for seeking and receiving the broken yarn end wound on the spool, with means for the return of the yarn end to the spinning unit, and with a vacuum connection that can be connected to the channel.

12. Apparatus according to claim 9, wherein the servicing unit is equipped with broken yarn end seeking means for seeking and receiving the broken yarn end wound on the spool, with inserting means for inserting the yarn end into the splicing means, with means for feeding a yarn end taken from an auxiliary spool arranged in the servicing unit to the channel of the spinning unit, with means for introducing this yarn end into the wedge-shaped gap of the spinning unit, with said yarn end withdrawal means, with means for detaching the yarn end with the yarn piecing, and with means for placing the newly formed yarn without the yarn piecing in the splicer.

13. Apparatus according to claim 9, wherein the servicing unit is equipped with broken yarn end seeking means for seeking and receiving of broken yarn end wound on the spool with means for the feeding of this yarn end to the channel of the spinning unit, with means for introducing this yarn end into the wedge-shaped gap, with means for the cutting into length of an indicated piece of yarn, with means for placing the remaining yarn end connected with the spool in the splicing means, with the yarn end withdrawal means for the withdrawal of the yarn end inserted into the wedge-shaped gap and of the new yarn pieced by means of a yarn piecing, with means for detaching the yarn end with the yarn piecing, and with means for placing the newly formed yarn without the yarn piecing in the splicing.

* * * * *